US012780383B2

(12) United States Patent
Kubota et al.

(10) Patent No.: US 12,780,383 B2
(45) Date of Patent: Nov. 3, 2026

(54) WATERCRAFT PROPULSION SYSTEM, AND WATERCRAFT INCLUDING THE WATERCRAFT PROPULSION SYSTEM

(71) Applicant: YAMAHA HATSUDOKI KABUSHIKI KAISHA, Iwata (JP)

(72) Inventors: Yuta Kubota, Shizuoka (JP); Akihiro Tagata, Shizuoka (JP); Katsutoshi Naito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 440 days.

(21) Appl. No.: 18/503,443

(22) Filed: Nov. 7, 2023

(65) Prior Publication Data

US 2024/0149999 A1 May 9, 2024

(30) Foreign Application Priority Data

Nov. 8, 2022 (JP) ..... 2022-178983

(51) Int. Cl.
*B63H 20/12* (2006.01)
*B63H 5/125* (2006.01)

(52) U.S. Cl.
CPC ..... *B63H 20/12* (2013.01); *B63H 5/125* (2013.01); *B63H 2005/1254* (2013.01)

(58) Field of Classification Search
CPC ..... B63H 20/12; B63H 5/125; B63H 2005/1254; B63H 2020/003;
(Continued)

(56) References Cited

U.S. PATENT DOCUMENTS 6,678,589 B2 * 1/2004 Robertson ..... B63H 25/42 701/530
10,640,190 B1 * 5/2020 Gonring ..... B63H 25/02
(Continued)

FOREIGN PATENT DOCUMENTS

JP 2000-001199 A 1/2000
JP 2017-128166 A 7/2017
(Continued)

OTHER PUBLICATIONS

Official Communication issued in corresponding European Patent Application No. 23208427.7, mailed on Apr. 9, 2024.

*Primary Examiner* — Andrew Polay
(74) *Attorney, Agent, or Firm* — Keating & Bennett, LLP

(57) ABSTRACT

A watercraft propulsion system includes a bow thruster at a bow of a hull to generate a lateral propulsive force, at least two propulsion devices on a stern of the hull each having a variable steering angle, and a controller configured or programmed to control the propulsive force of the bow thruster and control the propulsive forces and the steering angles of the two propulsion devices to perform an azimuth control to control an azimuth of the hull. The azimuth control includes a bow thruster mode in which the bow thruster is controlled, and a combinational mode in which the bow thruster is controlled and the two propulsion devices are driven forward and in reverse, respectively. The controller switches between the bow thruster mode and the combinational mode based on a predetermined switching condition during the azimuth control.

11 Claims, 17 Drawing Sheets

(58) Field of Classification Search
CPC ..... B63H 2025/026; B63H 5/14; B63H 5/16; B63H 25/42; B63H 25/46; B63H 5/08
See application file for complete search history.

(56) References Cited

U.S. PATENT DOCUMENTS

| | | | | |
|---|---|---|---|---|
| 2014/0046515 | A1* | 2/2014 | Mizutani | B63H 20/08 701/21 |
| 2017/0139426 | A1* | 5/2017 | Ito | B63H 25/42 |
| 2019/0061900 | A1 | 2/2019 | Hayashi et al. | |
| 2020/0331578 | A1* | 10/2020 | Sakashita | B63H 5/125 |
| 2020/0398964 | A1 | 12/2020 | Fujima et al. | |

FOREIGN PATENT DOCUMENTS

| | | | |
|---|---|---|---|
| WO | 2019/159289 | A1 | 8/2019 |
| WO | 2020069750 | A1 | 4/2020 |

* cited by examiner

FIG. 15

| Lv | Low | Medium | High |
|---|---|---|---|
| 1 | ***** | ***** | ***** |
| 2 | ***** | ***** | ***** |
| 3 | ***** | ***** | ***** |
| 4 | ***** | ***** | ***** |
| 5 | ***** | ***** | 100 |

WATERCRAFT PROPULSION SYSTEM, AND WATERCRAFT INCLUDING THE WATERCRAFT PROPULSION SYSTEM

CROSS REFERENCE TO RELATED APPLICATIONS

This application claims the benefit of priority to Japanese Patent Application No. 2022-178983 filed on Nov. 8, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

JP-A-2000-1199 discloses a steering device adapted to maintain the azimuth of a watercraft at a given azimuth. The watercraft includes a rudder and a propulsion device (propeller) provided on the stern thereof, and thrusters respectively provided in the vicinity of the bow and the stern thereof. Actuators for the rudder, the propeller, and the thrusters are controlled according to the influence of external disturbances (wind, wave, tidal current and the like) and the azimuthal offset of the watercraft. In an azimuth holding operation, the rudder, the propeller, and the thrusters are all controlled to generate a greater propulsive force when the external disturbance or the azimuthal offset is great. When the external disturbance and the azimuthal offset are small, on the other hand, only the thrusters are controlled to generate a small propulsive force.

SUMMARY OF THE INVENTION

The inventors of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

The inventors conducted studies on a watercraft propulsion system including a bow thruster provided at the bow of a hull, and a plurality of propulsion devices provided on the stern of the hull. JP-A-2000-1199 discloses nothing about the construction of such a watercraft propulsion system. The azimuth holding control disclosed in JP-A-2000-1199 cannot be properly used as it is for a watercraft propulsion system, and still has room for improvement.

In view of the foregoing, preferred embodiments of the present invention provide specific azimuth control techniques suitable for watercraft propulsion systems and watercraft including a bow thruster provided at a bow of the watercraft, and a plurality of propulsion devices provided on a stern of the watercraft.

In order to overcome the previously unrecognized and unsolved challenges described above, a preferred embodiment of the present invention provides a watercraft propulsion system including a bow thruster at the bow of a hull to generate a lateral propulsive force, at least two propulsion devices provided on the stern of the hull each having a variable steering angle, and a controller configured or programmed to control the propulsive force of the bow thruster, and control the propulsive forces and the steering angles of the two propulsion devices to perform an azimuth control to control the azimuth of the hull. The azimuth control includes a bow thruster mode in which the propulsive force of the bow thruster is controlled to adjust the hull azimuth, and a combinational mode in which the propulsive force of the bow thruster is controlled and the two propulsion devices are driven forward and in reverse, respectively, to adjust the hull azimuth. The controller is configured or programmed to switch between the bow thruster mode and the combinational mode based on a predetermined switching condition in the azimuth control.

With this arrangement, a bow turning moment is applied to the hull by the propulsive force of the bow thruster to adjust the hull azimuth in the bow thruster mode. In the combinational mode, on the other hand, the bow turning moment is applied to the hull not only by the propulsive force of the bow thruster but also by the propulsive forces of the two propulsion devices provided on the stern by the forward driving and the reverse driving of the propulsion devices to adjust the hull azimuth. Therefore, a greater bow turning moment can be applied to the hull in the combinational mode than in the bow thruster mode. Therefore, the azimuth control can be highly precisely performed by switching between the bow thruster mode and the combinational mode by properly defining the switching condition.

In the bow thruster mode, the propulsive forces and the steering angles of the two propulsion devices may be additionally controlled. For example, the two propulsion devices may be both driven forward or driven in reverse, and the propulsive forces and the steering angles of the two propulsion devices may be adjusted for the azimuth control of the hull.

A position control may be performed in addition to the azimuth control. Specifically, the position control may be performed to adjust the position of the hull by controlling the propulsive force of the bow thruster and/or by controlling the two propulsion devices (by controlling the propulsive forces and the steering angles of the two propulsion devices). Where the azimuth control and the position control are simultaneously performed, the propulsive force generated by the bow thruster may be partially contributable to the azimuth control, and the rest of the propulsive force generated by the bow thruster may be contributable to the position control. Further, propulsive forces generated by the propulsion devices may be partially contributable to the azimuth control, and the rest of the propulsive forces generated by the propulsion devices may be contributable to the position control. Since the hull azimuth can be adjusted by the propulsive force of the bow thruster in the bow thruster mode, there is no need to allocate a greater proportion of the propulsive forces of the stern propulsion devices for the azimuth control. Thus, the position control can be highly precisely performed.

In a preferred embodiment of the present invention, the propulsive forces generated by the two propulsion devices in the bow thruster mode are not contributable to the adjustment of the hull azimuth.

The two propulsion devices provided on the stern may be stopped, or the propulsive forces and the steering angles of the two propulsion devices may be controlled for the position control to adjust the hull position. By stopping the propulsion devices, quietness can be improved. Where the propulsive forces of the propulsion devices are used for the adjustment of the hull position, the propulsive forces can be dedicated to the position control. Thus, there is no need to allocate the propulsive forces of the propulsion devices for the azimuth control. This improves the precision of the position control.

In a preferred embodiment of the present invention, the switching condition includes a combinational mode switching condition to switch from the bow thruster mode to the combinational mode, and the combinational mode switching condition includes at least one of a condition such that an output requirement value for the bow thruster is not less than a first threshold (hereinafter referred to as "first switching condition") or a condition such that a propulsive force requirement value for anteroposterior propulsive forces to be generated anteroposteriorly of the hull is not less than a second threshold (hereinafter referred to as "second switching condition").

If the azimuth of the hull is significantly offset from a target azimuth or if the azimuthal offset is not reduced due to external disturbance, a greater bow turning moment is required, so that the output requirement value for the bow thruster is increased. Then, the first switching condition is satisfied, and the bow thruster mode is switched to the combinational mode such that the hull azimuth can be adjusted to the target azimuth by the greater bow turning moment. On the other hand, the studies conducted by the inventors reveal that, where the anteroposterior propulsive forces generated by the stern propulsion devices are great, the bow turning moment applied by the propulsive force of the bow thruster does not effectively act on the hull and, therefore, is insufficient. In such a situation, the second switching condition is satisfied, so that the bow turning mode is switched to the combinational mode. Thus, a necessary bow turning moment can be provided to adjust the hull azimuth to the target azimuth. Therefore, at least one of the first switching condition or the second switching condition is used as the combinational mode switching condition such that the precision of the azimuth control can be improved.

In a preferred embodiment of the present invention, the bow thruster mode is switched to the combinational mode if at least one of the first switching condition or the second switching condition is satisfied.

With this arrangement, the switching to the combinational mode occurs if at least one of the first switching condition or the second switching condition is satisfied. This improves the precision of the azimuth control.

In a preferred embodiment of the present invention, the switching condition includes a bow thruster mode switching condition to switch from the combinational mode to the bow thruster mode, and the bow thruster mode switching condition includes at least one of a condition such that the output requirement value for the bow thruster is not greater than a third threshold (hereinafter referred to as "third switching condition") or a condition such that the propulsive force requirement value for the anteroposterior propulsive forces to be generated anteroposteriorly of the hull is not greater than a fourth threshold (hereinafter referred to as "fourth switching condition").

If the azimuthal offset of the hull from the target azimuth is reduced and the influence of the external disturbance is small, the bow turning moment required for the azimuth adjustment is reduced and the output requirement value for the bow thruster is correspondingly reduced. Then, the third switching condition to switch to the bow thruster mode is satisfied. Where the anteroposterior propulsive forces generated by the stern propulsion devices are not so great, on the other hand, the bow turning moment applied by the propulsive force of the bow thruster effectively acts on the hull. In such a situation, the fourth switching condition to switch to the bow thruster mode is satisfied. In the bow thruster mode, there is no need to allocate a greater proportion of the propulsive forces of the stern propulsion devices for the adjustment of the hull azimuth. Therefore, the propulsive forces of the stern propulsion devices can be mostly used for the position control, or the generation of the propulsive forces can be stopped to improve the quietness.

In a preferred embodiment of the present invention, the combinational mode is switched to the bow thruster mode if both the third switching condition and the fourth switching condition are satisfied.

With this arrangement, the condition to switch to the bow thruster mode is that both the third switching condition and the fourth switching condition are satisfied. Therefore, the combinational mode is switched to the bow thruster mode in a situation such that the azimuth adjustment can be properly achieved in the bow thruster mode. Thus, there is no need to allocate a greater proportion of the propulsive forces of the stern propulsion devices for the adjustment of the hull azimuth. Therefore, the propulsive forces of the stern propulsion devices can be mostly used for the position control, or the generation of the propulsive forces can be stopped to improve the quietness.

In a preferred embodiment of the present invention, the watercraft propulsion system further includes an upper output limit setter to be operated by a user (an operator) to set the upper output limit of the bow thruster, and the first threshold for the first switching condition is variably set based on the upper output limit set by the upper output limit setter.

The user sets the upper output limit of the bow thruster such that the propulsive force to be generated by the bow thruster can be adjusted. Thus, the bow thruster can be tuned according to the skill level and the preference of the user. For example, the maneuverability of the watercraft can be improved by setting the upper output limit at a higher level, and the energy consumption of the watercraft can be reduced by setting the upper output limit at a lower level. Where the first threshold is automatically variably set in association with the setting of the upper output limit, the combinational mode can be properly switched to the bow thruster mode without the need for an additional setting operation.

In a preferred embodiment of the present invention, the watercraft propulsion system includes the upper output limit setter to be operated by the user to set the upper output limit of the bow thruster, and the third threshold for the third switching condition is variably set based on the upper output limit set by the upper output limit setter.

With this arrangement, where the third switching condition is automatically variably set in association with the setting of the upper output limit of the bow thruster, the bow thruster mode can be properly switched to the combinational mode without the need for an additional setting operation.

In a preferred embodiment of the present invention, the controller is configured or programmed to perform the azimuth control during an automatic watercraft maneuvering control in which the position of the hull is maintained with the bow or the stern of the hull directed against the movement direction of the hull.

In the bow thruster mode, for example, the bow or the stern is directed against the movement direction of the hull by the azimuth control by utilizing the propulsive force of the bow thruster and, on the other hand, the position control can be performed to maintain the hull position by the forward driving or the reverse driving of the stern propulsion devices. The stern propulsion devices may be steered as required, and the propulsive forces of the stern propulsion devices may be partially contributable to the azimuth control.

In a preferred embodiment of the present invention, the controller is configured or programmed to perform the azimuth control during an automatic watercraft maneuvering control in which the position of the hull is not maintained and the bow azimuth of the hull is maintained at the target azimuth.

In this case, the default mode of the controller is preferably the bow thruster mode, and the stern propulsion devices are preferably in a stop state so as not to generate the propulsive forces. The bow thruster applies no or substantially no anteroposterior propulsive force to the hull. Therefore, the stop state of the stern propulsion devices makes it possible to maintain the hull azimuth while moving the hull along a tidal current, for example. In addition, the stop state of the stern propulsion devices can improve the quietness.

In a preferred embodiment of the present invention, the watercraft propulsion system further includes a target azimuth setter to be operated by the user to set the target azimuth. If the amount of a change in the target azimuth set by the target azimuth setter is not less than a fifth threshold, the bow thruster mode is switched to the combinational mode. If the yaw rate of the hull is not greater than a sixth threshold and the outputs of the two propulsion devices are not greater than a seventh threshold after the bow azimuth reaches the target azimuth, the combinational mode is switched to the bow thruster mode.

With this arrangement, if the amount of the change in the target azimuth is great, the bow thruster mode is switched to the combinational mode and, therefore, the hull azimuth can be speedily adjusted to the changed target azimuth by applying a greater bow turning moment to the hull. After the target azimuth is reached, on the other hand, the combinational mode is switched to the bow thruster mode on condition that the yaw rate of the hull is small and the outputs of the stern propulsion devices are small. Thus, the combinational mode can be smoothly switched to the bow thruster mode in a state such that the hull behavior is stabilized and the propulsion devices do not apply greater propulsive forces.

In a preferred embodiment of the present invention, the controller is configured or programmed to perform the azimuth control during an automatic watercraft maneuvering control in which the position of the hull is maintained on a specified route and the bow azimuth of the hull is maintained at the target azimuth.

In the bow thruster mode, for example, the hull azimuth is maintained at the target azimuth by the azimuth control by utilizing the propulsive force of the bow thruster and, on the other hand, the position control can be performed to maintain the hull position on the route by the forward driving or the reverse driving of the stern propulsion devices. The stern propulsion devices may be steered as required, and the propulsive forces of the stern propulsion devices may be partially contributable to the azimuth control.

Further, the target azimuth can be changed by operating the target azimuth setter. In this case, the switching between the bow thruster mode and the combinational mode may occur based on at least one of the first switching condition, the second switching condition, the third switching condition, or the fourth switching condition according to the change in the target azimuth. As in the aforementioned case, the switching between the bow thruster mode and the combinational mode may occur according to the determination based on the fifth threshold, the sixth threshold, and the seventh threshold.

In a preferred embodiment of the present invention, the controller may be configured or programmed to perform the azimuth control during an automatic watercraft maneuvering control in which the bow azimuth of the hull is maintained during sailing.

Particularly during low speed sailing, the bow turning moment generated by the propulsive force of the bow thruster efficiently acts on the hull and, therefore, the bow thruster mode is preferably utilized for the azimuth control in low speed sailing at not higher than a predetermined speed. In the bow thruster mode, the stern propulsion devices are steered as required, and the propulsive forces of the stern propulsion devices may be partially contributable to the azimuth control. Where the bow azimuth is significantly offset from the target azimuth due to the influence of the external disturbance or the like, for example, the bow thruster mode is switched to the combinational mode. Thus, the bow azimuth can be speedily returned to the target azimuth.

Another preferred embodiment of the present invention provides a watercraft including a hull, and a watercraft propulsion system provided on the hull and including any of the aforementioned features.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 15 is a diagram for describing the features of the setting of the output level of a bow thruster.

DETAILED DESCRIPTION OF THE PREFERRED EMBODIMENTS

Figure 1:
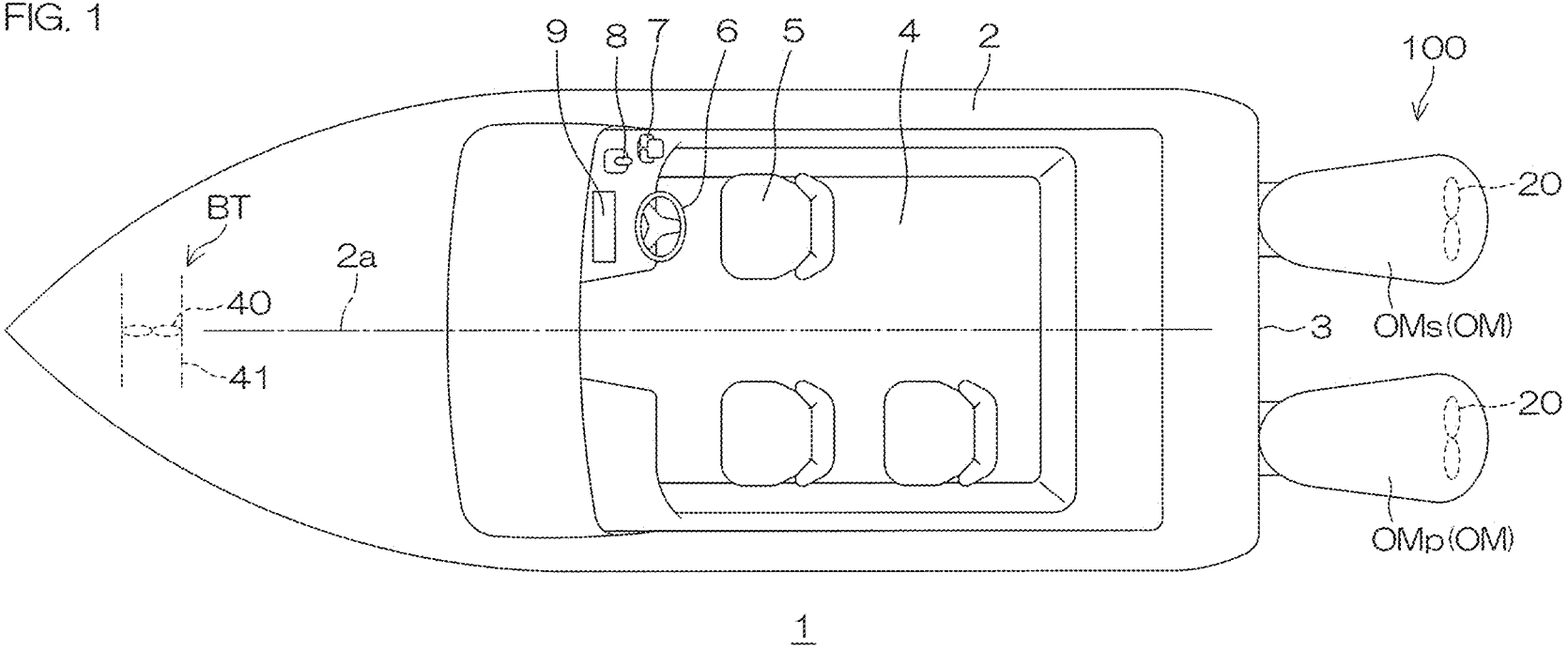
FIG. 1 is a plan view showing an exemplary construction of a watercraft mounted with a watercraft propulsion system according to a preferred embodiment of the present invention.

FIG. 1 is a plan view showing an exemplary construction of a watercraft 1 mounted with a watercraft propulsion system 100 according to a preferred embodiment of the present invention. The watercraft 1 includes a hull 2, a bow thruster BT provided at the bow of the hull 2 to generate a lateral propulsive force, and outboard motors OM (examples of the propulsion devices) provided on the stern 3 of the hull 2 and each having a variable steering angle. In this preferred embodiment, a plurality of outboard motors OM, more specifically, two outboard motors OM are provided on the stern 3.

The two outboard motors OM are disposed side by side transversely of the hull 2 on the stern 3. For discrimination between the two outboard motors OM, one of the outboard motors OM disposed rightward relative to the other outboard motor OM is referred to as "starboard-side outboard motor OMs" and the other outboard motor OM disposed leftward relative to the one outboard motor OM is referred to as "port-side outboard motor OMp." In this example, the starboard-side outboard motor OMs is disposed on the right side of a center line 2*a* extending anteroposteriorly of the hull 2, and the port-side outboard motor OMp is disposed on the left side of the center line 2*a*. More specifically, the starboard-side outboard motor OMs and the port-side outboard motor OMp are disposed symmetrically with respect to the center line 2*a*.

The outboard motors OM each include a propeller 20 located underwater, and are each configured to generate a propulsive force by the rotation of the propeller 20 and apply the propulsive force to the hull 2. The outboard motors OM are each attached to the stern 3 pivotably leftward and rightward such that the direction of the propulsive force generated by the propeller 20 is changed leftward and rightward. The steering angle is defined, for example, as an angle between the direction of the propulsive force generated by the propeller 20 and an anteroposterior reference direction parallel to the center line 2*a*. The outboard motors OM are each configured to be pivoted leftward and rightward by a steering mechanism 26 thereof (see FIG. 2) to change the steering angle. When the propulsive force direction is parallel to the anteroposterior direction, the steering angle is zero. When the rear end of the outboard motor OM is directed rightward, the steering angle may be expressed with a positive sign. When the rear end of the outboard motor OM is directed leftward, the steering angle may be expressed with a negative sign.

The bow thruster BT includes a propeller 40 disposed in a tubular tunnel 41 extending through the bow portion of the hull 2 transversely of the hull 2. The propeller 40 is rotatable in a forward rotation direction and a reverse rotation direction, i.e., is bidirectionally rotatable such that the bow thruster BT can apply a rightward or leftward propulsive force to the hull 2. In this preferred embodiment, the direction of the propulsive force to be generated by the bow thruster BT cannot be set to a direction other than the rightward direction and the leftward direction.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operator to be operated by a user (an operator) to change the course of the watercraft 1. The remote control lever 7 is an operator to be operated by the user to change the magnitudes (outputs) and the directions (forward or reverse directions) of the propulsive forces of the outboard motors OM, and corresponds to an acceleration operator. The joystick 8 is an operator to be operated instead of the steering wheel 6 and the remote control lever 7 by the user for watercraft maneuvering operation. An operator 45 (see FIG. 2) dedicated for the operation of the bow thruster BT may be provided in addition to the aforementioned operators.

Figure 2:
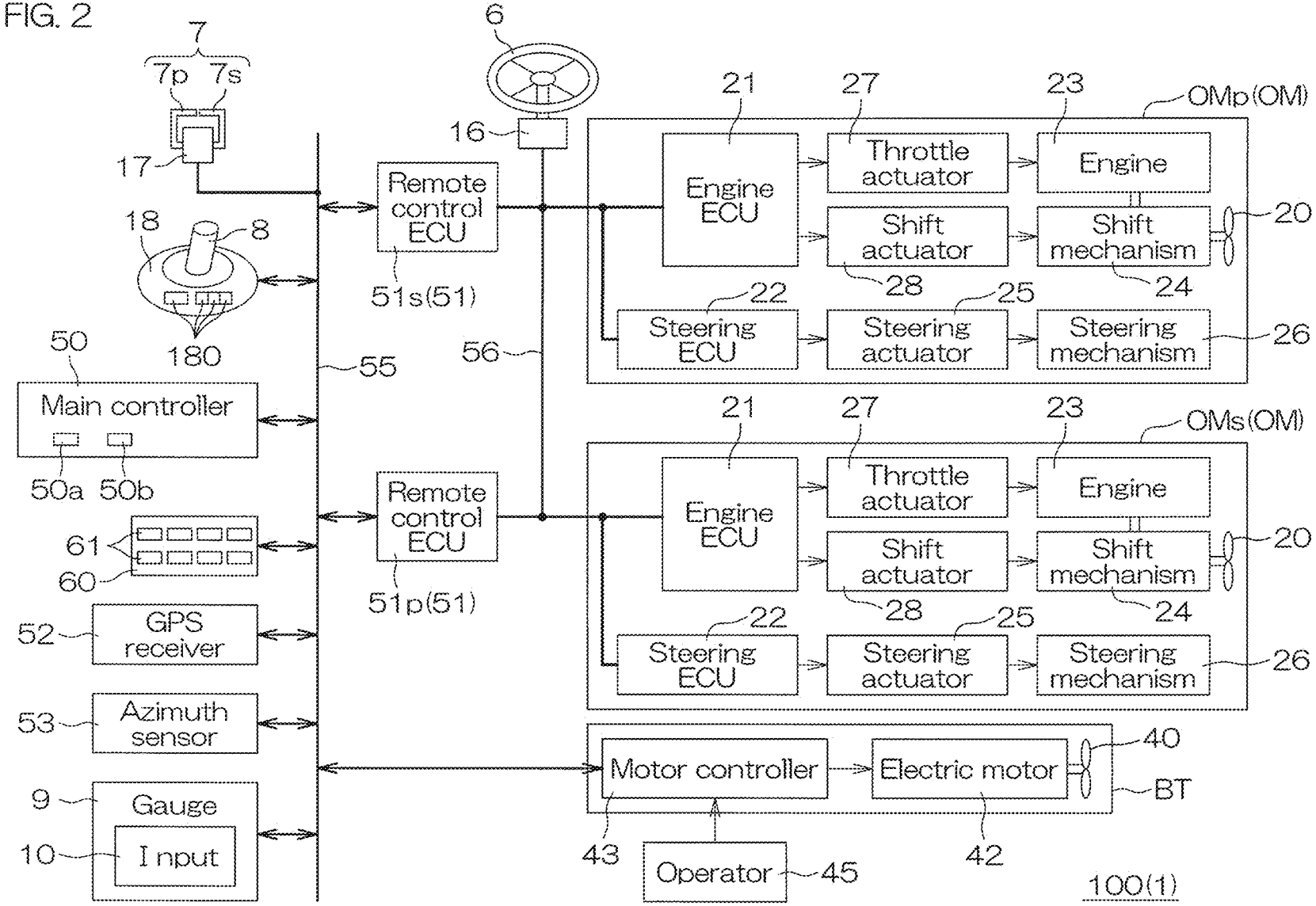
FIG. 2 is a block diagram showing a configuration of the watercraft propulsion system by way of example.

FIG. 2 is a block diagram showing the configuration of the watercraft propulsion system 100 provided in the watercraft 1 by way of example. The watercraft propulsion system 100 includes the two outboard motors OM and the bow thruster BT. The outboard motors OM may each be an engine outboard motor or an electric outboard motor. In FIG. 2, the outboard motors OM are engine outboard motors by way of example.

The outboard motors OM each include an engine ECU (Electronic Control Unit) 21, a steering ECU 22, an engine 23, a shift mechanism 24, a propeller 20, the steering mechanism 26 and the like. Power generated by the engine 23 is transmitted to the propeller 20 via the shift mechanism 24. The steering mechanism 26 is configured to pivot the body of the outboard motor OM leftward and rightward with respect to the hull 2 (see FIG. 1) to change the direction of the propulsive force generated by the outboard motor OM leftward and rightward. The shift mechanism 24 is configured to select a shift position from a forward shift position, a reverse shift position, and a neutral shift position. With the shift position set to the forward shift position, the propeller 20 is rotated in a forward rotation direction by the transmission of the rotation of the engine 23 such that the outboard motor OM is brought into a forward drive state to generate a forward propulsive force. With the shift position set to the reverse shift position, the propeller 20 is rotated in a reverse rotation direction by the transmission of the rotation of the engine 23 such that the outboard motor OM is brought into a reverse drive state to generate a reverse propulsive force. With the shift position set to the neutral shift position, the power transmission between the engine 23 and the propeller 20 is interrupted such that the outboard motor OM is brought into an idling state.

The outboard motors OM each further include a throttle actuator 27 and a shift actuator 28, which are controlled by the engine ECU 21. The throttle actuator 27 is an electric actuator (typically including an electric motor) that actuates the throttle valve (not shown) of the engine 23. The shift actuator 28 actuates the shift mechanism 24. The outboard motors OM each further include a steering actuator 25 to be controlled by the steering ECU 22. The steering actuator 25 is the drive source of the steering mechanism 26, and typically includes an electric motor. The steering actuator 25 may include a hydraulic device of electric pump type.

The bow thruster BT includes the propeller 40, an electric motor 42 that drives the propeller 40, and a motor controller 43 that controls the electric motor 42.

The watercraft propulsion system 100 further includes a main controller 50. The main controller 50 includes a processor 50*a* and a memory 50*b*, and is configured so that the processor 50*a* executes a program stored in the memory 50*b* to perform a plurality of functions. The main controller 50 is connected to an onboard network 55 (CAN: Control Area Network) provided in the hull 2. A remote control unit 17, two remote control ECUs 51, a joystick unit 18, a GPS (Global Positioning System) receiver 52, an azimuth sensor 53 and the like are connected to the onboard network 55.

The two remote control ECUs 51 (51*s*, 51*p*) are provided in association with the two outboard motors OM (OMs, OMp), respectively, and are connected to the onboard network 55. The engine ECU 21 and the steering ECU 22 of the starboard-side outboard motor OMs, and the engine ECU 21 and the steering ECU 22 of the port-side outboard motor OMp are connected to the corresponding remote control ECUs 51*s*, 51*p* via an outboard motor control network 56. The main controller 50 transmits and receives signals to/from various units connected to the onboard network 55 to control the outboard motors OM and the bow thruster BT, and further controls other units. The main controller 50 includes a plurality of control modes, and controls the units in predetermined manners according to the respective control modes.

A steering wheel unit 16 is connected to the outboard motor control network 56. The steering wheel unit 16 outputs an operation angle signal indicating the operation angle of the steering wheel 6 to the outboard motor control network 56. The operation angle signal is received by the remote control ECUs 51 and the steering ECUs 22. In response to the operation angle signal generated by the steering wheel unit 16 or steering angle commands respectively generated by the remote control ECUs 51, the steering ECUs 22 of the outboard motors OM respectively control the steering actuators 25 to control the steering angles of the outboard motors OM.

The remote control unit 17 generates an operation position signal indicating the operation position of the remote control lever 7. The remote control unit 17 includes a starboard-side remote control lever 7*s* and a port-side remote control lever 7*p* respectively provided in association with the starboard-side outboard motor OMs and the port-side outboard motor OMp.

The joystick unit 18 generates an operation position signal indicating the operation position of the joystick 8, and generates an operation signal indicating the operation of any of operation buttons 180 provided in the joystick unit 18.

The remote control ECUs 51 each output a propulsive force command to the corresponding engine ECU 21 via the outboard motor control network 56. The propulsive force command includes a shift command indicating the shift position, and an output command indicating an engine output (specifically, an engine rotation speed). Further, the remote control ECUs 51 each output the steering angle command to the corresponding steering ECU 22 via the outboard motor control network 56.

The remote control ECUs 51 each perform different control operations according to different control modes of the main controller 50. In a control mode for watercraft maneuvering with the use of the steering wheel 6 and the remote control lever 7, for example, the remote control ECUs 51 each generate the propulsive force command (the shift command and the output command) according to the operation position signal generated by the remote control unit 17, and each apply the propulsive force command (the shift command and the output command) to the corresponding engine ECU 21. Further, the remote control ECUs 51 each command the corresponding steering ECU 22 to conform to the operation angle signal generated by the steering wheel unit 16. In a control mode for watercraft maneuvering without the use of the steering wheel 6 and the remote control lever 7, on the other hand, the remote control ECUs 51 each conform to commands applied by the main controller 50. That is, the main controller 50 generates the propulsive force command (the shift command and the output command) and the steering angle command, and the remote control ECUs 51 each output the propulsive force command (the shift command and the output command) and the steering angle command to the engine ECU 21 and the steering ECU 22, respectively. In a control mode for watercraft maneuvering with the use of the joystick 8 (joystick mode), for example, the main controller 50 generates the propulsive force command (the shift command and the output command) and the steering angle command according to the signals generated by the joystick unit 18. The magnitude and the direction (the forward direction or the reverse direction) of the propulsive force and the steering angle of each of the outboard motors OM are controlled according to the propulsive force command (the shift command and the output command) and the steering angle command thus generated.

The engine ECU 21 of each of the outboard motors OM drives the shift actuator 28 according to the shift command to control the shift position, and drives the throttle actuator 27 according to the output command to control the throttle opening degree of the engine 23. The steering ECU 22 of each of the outboard motors OM controls the steering actuator 25 according to the steering angle command to control the steering angle of the outboard motor OM.

The motor controller 43 of the bow thruster BT is connected to the onboard network 55, and is configured to actuate the electric motor 42 in response to a command applied from the main controller 50. The main controller 50 applies a propulsive force command to the motor controller 43. The propulsive force command includes a shift command and an output command. The shift command is a rotation direction command that indicates the stop, the forward rotation, or the reverse rotation of the propeller 20. The output command is a rotation speed command that indicates a propulsive force to be generated, specifically, a target rotation speed value. The motor controller 43 controls the rotation direction and the rotation speed of the electric motor 42 according to the shift command (rotation direction command) and the output command.

In this example, the operator 45 dedicated for the bow thruster BT is connected to the motor controller 43. The user can adjust the rotation direction and the rotation speed of the bow thruster BT by operating the operator 45.

The GPS receiver 52 is an exemplary position detecting device. The GPS receiver 52 detects the position of the watercraft 1 by receiving radio waves from an artificial satellite orbiting the earth, and outputs position data indicating the position of the watercraft 1 and speed data indicating the moving speed of the watercraft 1. The main controller 50 acquires the position data and the speed data, which are used to control and display the position and/or the azimuth of the watercraft 1.

The azimuth sensor 53 detects the azimuth of the watercraft 1, and generates azimuth data, which is used by the main controller 50.

The gauge 9 is also connected to the onboard network 55. The gauge 9 is a display device that displays various information for the watercraft maneuvering. The gauge 9 can communicate, for example, with the main controller 50, the remote control ECUs 51 and the motor controller 43. Thus, the gauge 9 can display information such as of the operation states of the outboard motors OM, the operation state of the bow thruster BT, and the position and/or the azimuth of the watercraft 1. The gauge 9 may include an input device 10 such as a touch panel and buttons. The input device 10 may be operated by the user to set various settings and provide various commands such that operation signals are outputted to the onboard network 55. An additional network other than the onboard network 55 may be provided to transmit display control signals related to the gauge 9.

Further, an application switch panel 60 is connected to the onboard network 55. The application switch panel 60 includes a plurality of function switches 61 to be operated to apply predefined function commands. For example, the function switches 61 may include switches for automatic watercraft maneuvering commands. More specifically, a command for a bow holding mode (Heading Hold) in which an automatic steering operation is performed to maintain the bow azimuth during forward sailing may be assigned to one of the function switches 61, and a command for a straight sailing holding mode (Course Hold) in which an automatic steering operation is performed to maintain the bow azimuth and a straight course during forward sailing may be assigned to another of the function switches 61. Further, a command for a route following mode (Track Point™) in which an automatic steering operation is performed to follow a course (route) passing through specified checkpoints may be assigned to further another of the function switches 61, and a command for a pattern sailing mode (Pattern Steer) in which an automatic steering operation is performed to follow a predetermined sailing pattern (zig-zag pattern, spiral pattern or the like) may be assigned to still another of the function switches 61.

Figure 3:
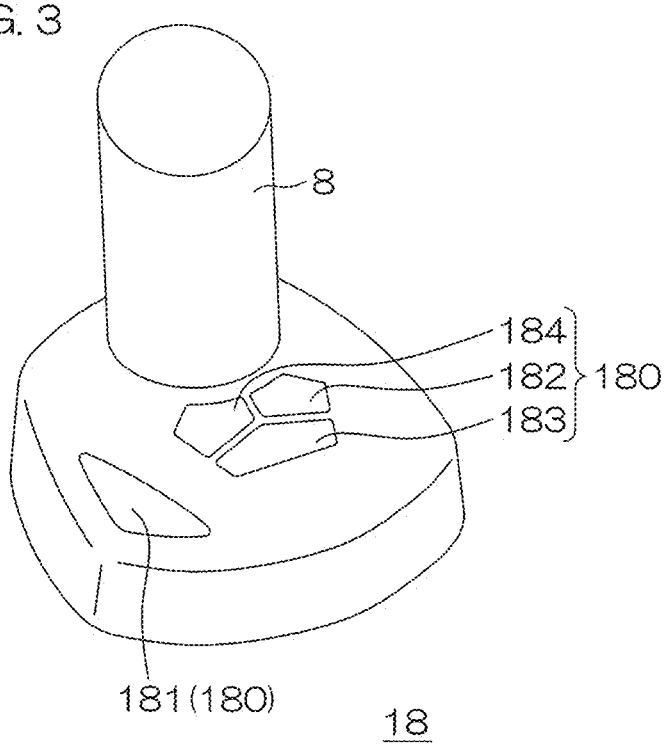
FIG. 3 is a perspective view showing the structure of a joystick unit by way of example.

FIG. 3 is a perspective view showing the structure of the joystick unit 18 by way of example. The joystick unit 18 includes the joystick 8, which can be inclined forward, backward, leftward, and rightward (i.e., in all 360-degree directions) and can be pivoted (twisted) about its axis. In this example, the joystick unit 18 further includes the operation buttons 180. The operation buttons 180 include a joystick button 181 and holding mode setting buttons 182 to 184.

The joystick button 181 is an operator to be operated by the user to select a control mode (watercraft maneuvering mode) utilizing the joystick 8, i.e., the joystick mode.

The holding mode setting buttons 182, 183, 184 are operation buttons to be operated by the user to select position/azimuth holding control modes (examples of an automatic watercraft maneuvering mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 50 can be classified into an ordinary mode, the joystick mode, or the automatic watercraft maneuvering mode in terms of the operation system.

In the ordinary mode, a steering control operation is performed according to the operation angle signal generated by the steering wheel unit 16, and a propulsive force control operation is performed according to the operation signal (operation position signal) of the remote control lever 7. In this preferred embodiment, the ordinary mode is a default control mode of the main controller 50. In the steering control operation, specifically, the steering ECUs 22 of the outboard motors OM respectively drive the steering actuators 25 according to the operation angle signal generated by the steering wheel unit 16 or the steering angle commands generated by the remote control ECUs 51. Thus, the bodies of the outboard motors OM are steered leftward and rightward such that the propulsive force directions of the outboard motors OM are changed leftward and rightward with respect to the hull 2. In the propulsive force control operation, specifically, the engine ECUs 21 of the outboard motors OM drive the shift actuators 28 and the throttle actuators 27 according to the propulsive force commands (the shift commands and the output commands) applied from the remote control ECUs 51 to the engine ECUs 21. Thus, the shift positions of the outboard motors OM are each set to the forward shift position, the reverse shift position, or the neutral shift position, and the engine outputs (specifically, the engine rotation speeds) of the outboard motors OM are changed.

In the joystick mode, the steering control operation and the propulsive force control operation are performed according to the operation signal of the joystick 8 of the joystick unit 18.

In the joystick mode, the steering control operation and the propulsive force control operation are performed on the outboard motors OM. That is, the main controller 50 applies the steering angle command and the propulsive force command to the remote control ECUs 51, and the remote control ECUs 51 apply the steering angle command to the steering ECUs 22 and apply the propulsive force command to the engine ECUs 21.

In the automatic watercraft maneuvering mode, the steering control operation and/or the propulsive force control operation are automatically performed by the functions of the main controller 50 and the like without the operation of the steering wheel 6, the remote control lever 7, and the joystick 8. That is, an automatic watercraft maneuvering operation is performed. The automatic watercraft maneuvering operation includes an automatic watercraft maneuvering operation to be performed on a sailing basis during sailing, and an automatic watercraft maneuvering operation to be performed on a position/azimuth holding basis to maintain the position and/or the azimuth. Examples of the automatic watercraft maneuvering operation on the sailing basis include the automatic steering operations to be selected by operating the function switches 61 as described above. Examples of the automatic watercraft maneuvering operation on the position/azimuth holding basis include watercraft maneuvering operations to be performed in the fixed point holding mode, the position holding mode, and the azimuth holding mode which are respectively selected by operating the holding mode setting buttons 182, 183, 184.

In this preferred embodiment, a cooperative mode in which the outboard motors OM and the bow thruster BT cooperate to achieve an intended hull behavior or a non-cooperative mode in which the outboard motors OM and the bow thruster BT do not cooperate can be selected in the joystick mode and the automatic watercraft maneuvering mode. A selection operator to be operated by the user to select the cooperative mode or the non-cooperative mode, for example, may be assigned to any of the function switches 61 provided on the application switch panel 60. In the cooperative mode, the main controller 50 performs the steering control operation and the propulsive force control operation on the outboard motors OM and, in addition, performs the propulsive force control operation on the bow thruster BT.

Figure 4A:
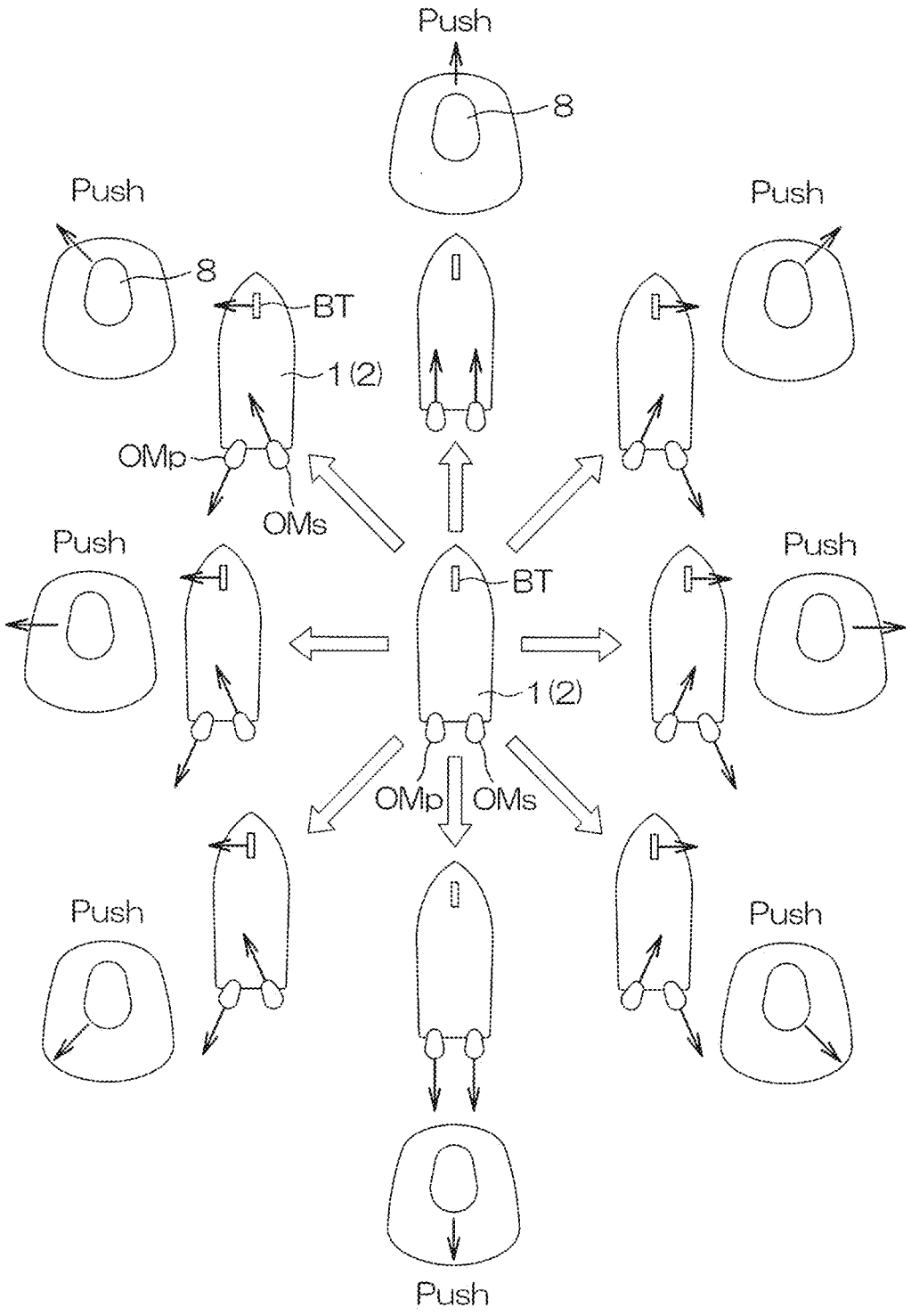
FIG. 4A is a diagram for describing a joystick mode in a cooperative mode showing operation states of a joystick and corresponding hull behaviors (translation).
Figure 4B:
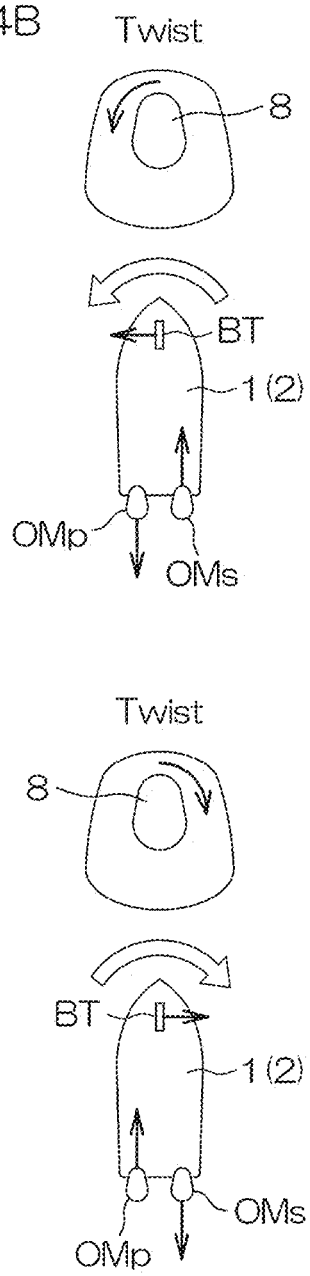
FIG. 4B is a diagram for describing the joystick mode in the cooperative mode showing operation states of the joystick and corresponding hull behaviors (fixed point bow turning).

FIGS. 4A and 4B are diagrams for describing the joystick mode in the cooperative mode showing operation states of the joystick 8 and corresponding behaviors of the hull 2. If the joystick mode is selected by operating the joystick button 181, the main controller 50 performs a joystick mode control operation. If the cooperative mode is selected before the joystick mode is selected, or if the cooperative mode is selected after the joystick mode is selected, the main controller 50 performs the joystick mode control operation according to the cooperative mode. If the cooperative mode is not selected, the main controller 50 performs the joystick mode control operation according to the non-cooperative mode.

The main controller 50 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 50 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 50 and inputted to the remote control ECUs 51, and the propulsive force command is inputted to the motor controller 43 of the bow thruster BT. The remote control ECUs 51 transmit the steering angle command to the steering ECUs 22 of the respective outboard motors OM, and transmit the propulsive force command to the engine ECUs 21 of the respective outboard motors OM. Thus, the outboard motors OM are respectively steered to steering angles according to the steering command, and the shift positions and the engine rotation speeds of the respective outboard motors OM are controlled to generate propulsive forces according to the propulsive force command. Further, the motor controller 43 controls the rotation direction and the rotation speed of the electric motor 42 so as to generate a propulsive force having a direction and a magnitude according to the propulsive force command.

When the joystick 8 is inclined without being pivoted in the joystick mode, the hull 2 is moved in a direction corresponding to the inclination direction of the joystick 8 without the bow turning, i.e., with its azimuth maintained. That is, the hull 2 is in a hull behavior of translation movement. Examples of the translation movement are shown in FIG. 4A.

Figure 5A:
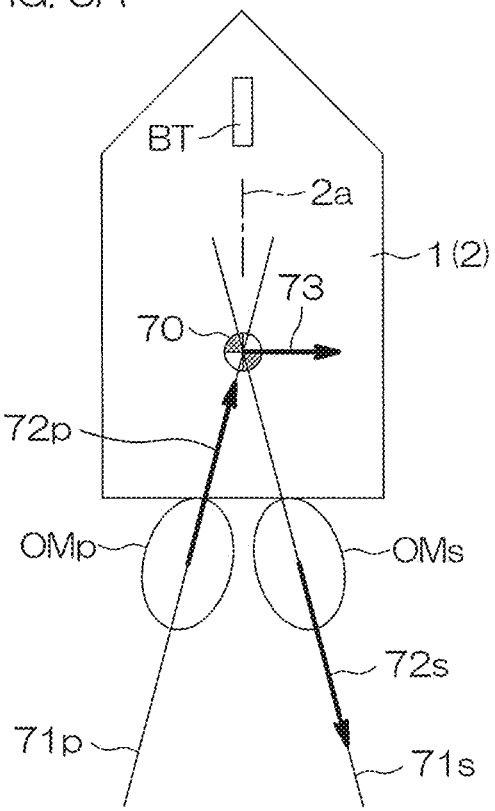
FIGS. 5A and 5B are diagrams for describing examples of the translation to be respectively observed in a non-cooperative mode and in the cooperative mode.
Figure 5B:
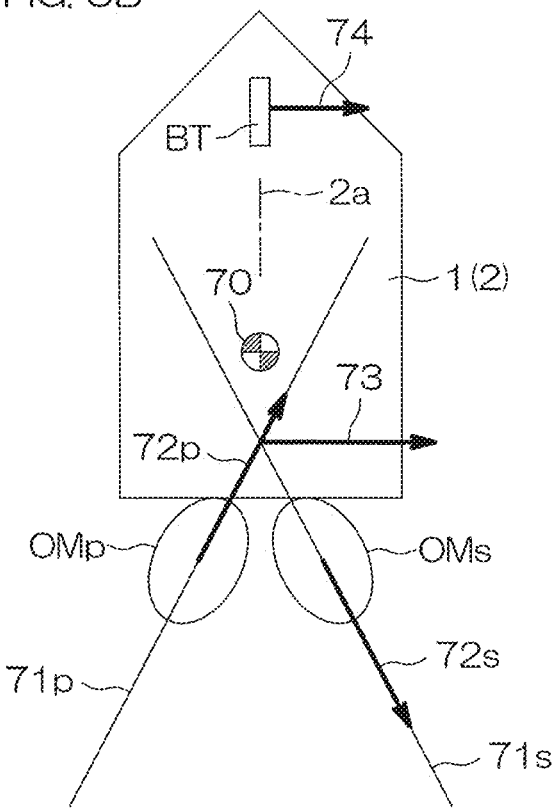

The translation movement is typically achieved by driving one of the outboard motors OM forward and driving the other outboard motor OM in reverse with the propulsive force action lines 71*s*, 71*p* of the two outboard motors OMs, OMp crossing each other in the hull 2 as shown in FIGS. 5A and 5B. The propulsive force action lines 71*s*, 71*p* respectively extend through the action points of the propulsive forces 72*s*, 72*p* of the outboard motors OMs, OMp along the directions of the propulsive forces 72*s*, 72*p*. The two outboard motors OM are steered in an inverted V-shaped orientation as seen in plan (in a so-called toe-in orientation). The steering angles of the outboard motors OM observed when the two outboard motors OM are thus steered in the inverted V-shaped orientation with their propulsive force action lines 71*s*, 71*p* crossing each other in the hull 2 are hereinafter referred to as "translation mode steering angles."

In the non-cooperative mode, as shown in FIG. 5A, the bow thruster BT is in a stop state, and the steering angles of the two outboard motors OM are controlled so that the propulsive force action lines 71*s*, 71*p* of the outboard motors OM cross each other at the turning center 70 (resistance center) of the hull 2. Thus, a resultant propulsive force 73 which is the resultant force of the propulsive forces 72*s*, 72*p* generated by the two outboard motors OMs, OMp causes the hull 2 to translate (to move laterally) without applying a moment to the hull 2.

In the cooperative mode, on the other hand, the bow thruster BT is actuated to generate a propulsive force as shown in FIG. 5B. The steering angles of the two outboard motors OM are controlled so that the propulsive force action lines 71*s*, 71*p* of the outboard motors OM cross each other on the rear side of the turning center 70 (resistance center) of the hull 2. The action point of the resultant propulsive force 73 of the propulsive forces 72*s*, 72*p* generated by the two outboard motors OM is the intersection of the propulsive force action lines 71*s*, 71*p* so that a moment is applied to the hull 2 about the turning center 70. On the other hand, the propulsive force 74 generated by the bow thruster BT also applies a moment to the hull 2 about the turning center 70. Therefore, the propulsive forces 72*s*, 72*p*, 74 of the outboard motors OM and the bow thruster BT are controlled so as to balance the moments applied to the hull 2 by the resultant propulsive force 73 of the two outboard motors OM and the propulsive force 74 of the bow thruster BT. Thus, the hull 2 translates (moves laterally) without the bow turning. In the cooperative mode in which the bow thruster BT and the two outboard motors OM are used in combination, the overall propulsive force contributable to the translation is greater than in the non-cooperative mode making it possible to smoothly translate the hull 2.

In this preferred embodiment, the translation mode steering angles are the steering angles of the two outboard motors OM observed when the propulsive force action lines 71*s*, 71*p* of the two outboard motors OM cross each other on a line extending anteroposteriorly through the turning center 70 in the hull 2 (on the center line 2*a* when the turning center 70 is on the center line 2*a*). In the non-cooperative mode, the translation mode steering angles without the bow turning of the hull 2 are the steering angles of the two outboard motors OM observed when the propulsive force action lines 71*s*, 71*p* of the two outboard motors OM cross each other at the turning center 70. In the cooperative mode, the translation mode steering angles without the bow turning of the hull 2 are the steering angles of the two outboard motors OM observed when the propulsive force action lines 71*s*, 71*p* of the two outboard motors OM cross each other on the rear side of the turning center 70. In the cooperative mode, the absolute values of the translation mode steering angles may be equal to the absolute values of the maximum steering angles (e.g., mechanical limit steering angles) of the outboard motors OM.

Figure 5C:
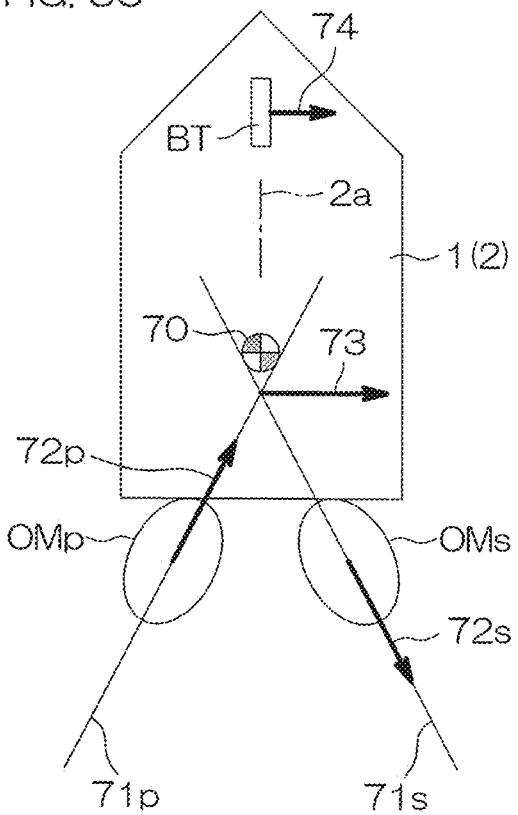
FIGS. 5C and 5D are diagrams for describing examples of the translation with bow turning to be observed in the cooperative mode.
Figure 5D:
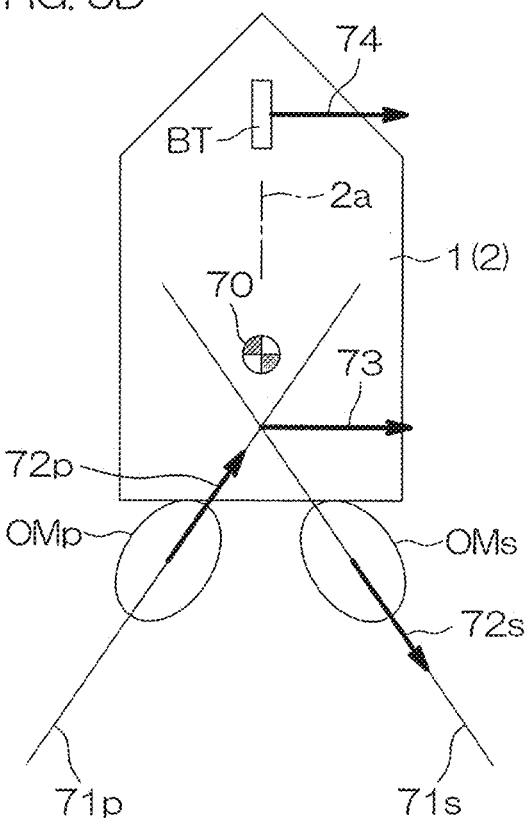

When the joystick 8 is inclined and pivoted, the hull 2 is in a hull behavior such that the bow is turned in a direction corresponding to the pivoting direction of the joystick 8 while the hull 2 is moved in a direction corresponding to the inclination direction of the joystick 8. In the cooperative mode, for example, the hull 2 can be translated with the bow turning depending on the magnitude balance between the propulsive force 74 of the bow thruster BT and the resultant propulsive force 73 of the two outboard motors OM as shown in FIGS. 5C and 5D.

In the non-cooperative mode, though not shown, the hull 2 can be translated with the bow turning by controlling the steering angles of the two outboard motors OM so that the propulsive force action lines 71*s*, 71*p* of the two outboard motors OM cross each other on the front side or the rear side of the turning center 70.

The resultant propulsive force 73 of the two outboard motors OM depends on the directions and the magnitudes of the propulsive forces 72*s*, 72*p* of the outboard motors OM, i.e., the steering angles and the outputs (engine rotation speeds) of the respective outboard motors OM. That is, even with the same engine outputs, the resultant propulsive force 73 is relatively reduced by reducing the absolute values of the steering angles to relatively reduce (or narrow) an angle defined between the two outboard motors OM as shown in FIG. 5C. Further, even with the same engine outputs, the resultant propulsive force 73 is relatively increased by increasing the absolute values of the steering angles to relatively increase (or expand) the angle defined between the two outboard motors OM as shown in FIG. 5D.

When the joystick 8 is pivoted (twisted) without being inclined in the joystick mode, the bow of the hull 2 is turned in a direction corresponding to the pivoting direction of the joystick 8 without any substantial position change. That is, the hull 2 is in a hull behavior of fixed point bow turning. Examples of the fixed point bow turning are shown in FIG. 4B.

At this time, the steering angles of the two outboard motors OM are set to zero, so that the two outboard motors OM generate propulsive forces parallel to the center line 2*a*. That is, the propulsive force action lines of the two outboard motors OM are parallel to the center line 2*a*, i.e., parallel to the anteroposterior direction of the hull 2. The steering angles of the two outboard motors OM observed at this time are hereinafter referred to as "bow turning mode steering angles." For the fixed point bow turning, one of the outboard motors OM is driven forward, and the other outboard motor OM is driven in reverse such that a moment can be applied to the hull 2 about the turning center. For the fixed point bow turning in a leftward direction (in a counterclockwise direction as seen in plan), the starboard-side outboard motor OMs is driven forward, and the port-side outboard motor OMp is driven in reverse. For the fixed point bow turning in a rightward direction (in a clockwise direction as seen in plan), the starboard-side outboard motor OMs is driven in reverse, and the port-side outboard motor OMp is driven forward.

In the non-cooperative mode, the bow thruster BT is in the stop state. In the cooperative mode, the bow thruster BT also generates a propulsive force to promote the bow turning. That is, the bow thruster BT applies a leftward propulsive force to the hull 2 for the fixed point bow turning in the leftward direction (in the counterclockwise direction as seen in plan). For the fixed point bow turning in the rightward direction (in the clockwise direction as seen in plan), the bow thruster BT applies a rightward propulsive force to the hull 2.

The fixed point holding mode (Stay Point™), the position holding mode (Fish Point™) and the azimuth holding mode (Drift Point™) to be respectively selected by operating the holding mode setting buttons 182, 183, and 184 (see FIG. 3) as described above are examples of the holding mode. In these holding modes, the propulsive forces and the steering angles of the outboard motors OM are controlled without any manual operation by the user. In the cooperative mode, the propulsive force of the bow thruster BT is also controlled.

In the fixed point holding mode (Stay Point™), for example, the main controller 50 controls the outputs and the steering angles of the outboard motors OM based on the position data and the speed data generated by the GPS receiver 52 and the azimuth data outputted by the azimuth sensor 53. In the cooperative mode, the propulsive force of the bow thruster BT is also controlled such that the positional change and the azimuthal change of the hull 2 can be reduced or minimized.

In the position holding mode (Fish Point™), the main controller 50 controls the propulsive forces and the steering angles of the outboard motors OM based on the position data and the speed data generated by the GPS receiver 52. In the cooperative mode, the propulsive force of the bow thruster BT is also controlled such that the positional change of the hull 2 is reduced or minimized. In the position holding mode, the movement direction of the hull 2 is detected, for example, based on a change in the position data generated by the GPS receiver 52. An azimuth control is performed to maintain the azimuth of the hull 2 so as to direct the bow or the stern in the movement direction. With the azimuth of the hull 2 thus maintained, the propulsive forces are applied anteroposteriorly to the hull 2 to maintain the position of the hull 2.

In the azimuth holding mode (Drift Point™), the main controller 50 controls the propulsive forces and the steering angles of the outboard motors OM based on the azimuth data generated by the azimuth sensor 53. In the cooperative mode, the propulsive force of the bow thruster BT is also controlled such that the azimuthal change of the hull 2 is reduced or minimized. In the cooperative mode, the azimuth of the hull 2 may be controlled to be maintained by utilizing only the propulsive force of the bow thruster BT.

FIGS. 6A to 6E are diagrams for describing two exemplary modes for the azimuth control. In this preferred embodiment, the azimuth control includes a bow thruster mode in which the azimuth of the hull 2 is adjusted by controlling the propulsive force of the bow thruster BT (see FIGS. 6A to 6C), and a combinational mode in which the azimuth of the hull 2 is adjusted by controlling the propulsive force of the bow thruster BT, and driving the two outboard motors OM forward and in reverse, respectively (see FIGS. 6D and 6E).

Figures 6A, 6B, 6C:
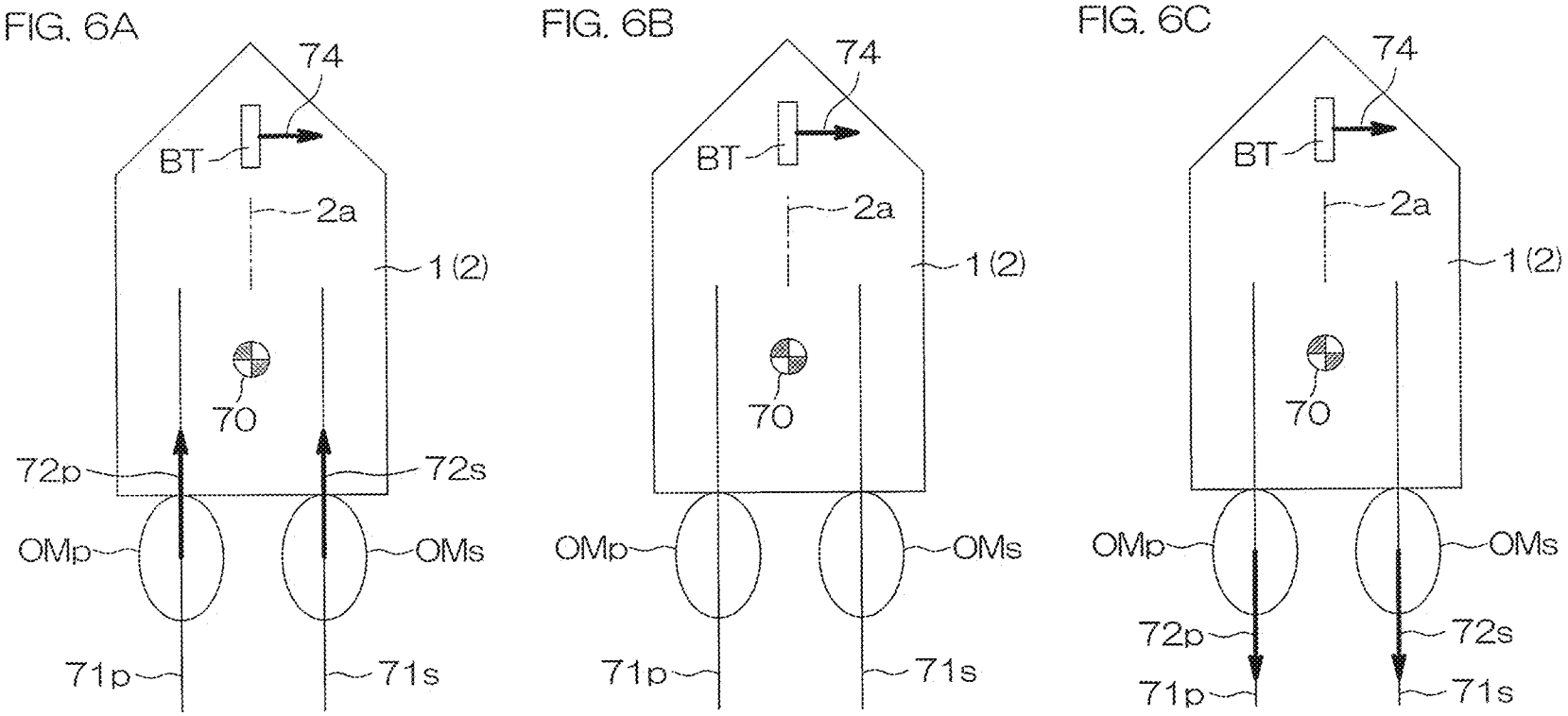
FIGS. 6A, 6B, and 6C are diagrams for describing a bow thruster mode for an azimuth control by way of example.

In one example of the bow thruster mode shown in FIGS. 6A, 6B, and 6C, the propulsive forces generated by the two outboard motors OM do not affect the azimuth of the hull 2. In the bow thruster mode, the two outboard motors OM are driven, as required, for a position control to adjust the position of the hull 2. For example, the steering angles of the two outboard motors OM are set to zero, and the two outboard motors OM respectively apply the propulsive forces 72*s*, 72*p* to the hull 2 in a forward or reverse direction along the center line 2*a*. That is, the two outboard motors OM are both driven forward (see FIG. 6A), are both stopped (in a neutral state) (see FIG. 6B), or are both driven in reverse (see FIG. 6C).

Figure 6D:
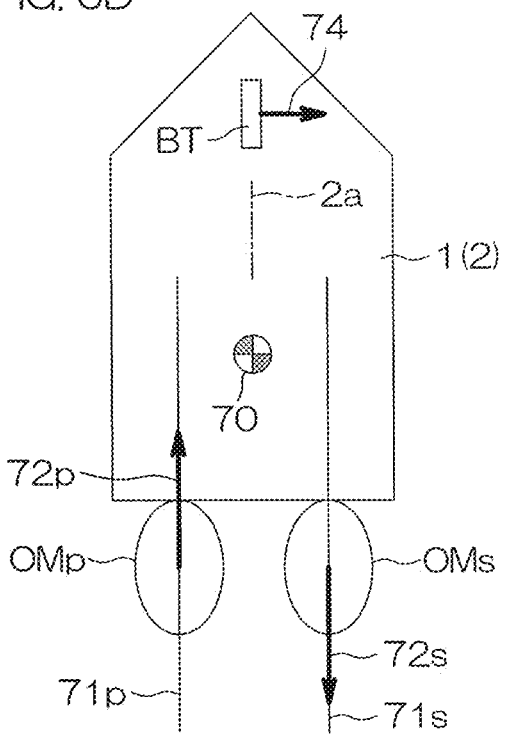
FIGS. 6D and 6E are diagrams for describing a combinational mode for the azimuth control by way of example.
Figure 6E:
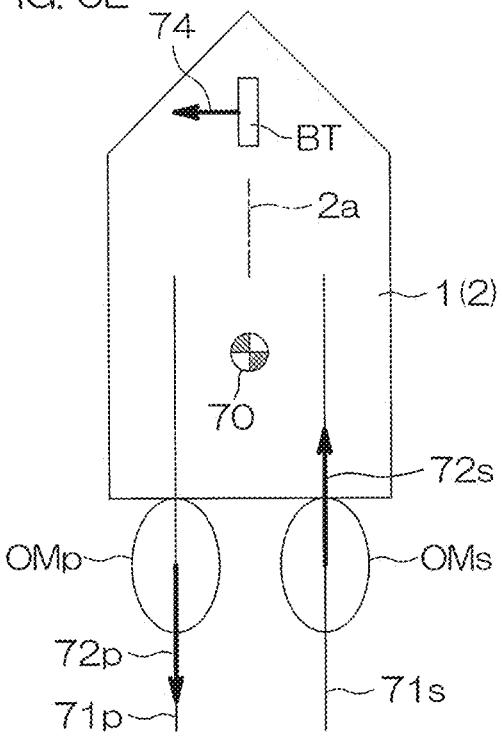

In the combinational mode, as shown in FIGS. 6D and 6E, the steering angles of the two outboard motors OM are set to zero (i.e., the bow turning mode steering angles). Then, the two outboard motors OM respectively apply the propulsive forces 72*s*, 72*p* to the hull 2 in the forward and reverse directions along the center line 2*a*. In the combinational mode, however, one of the two outboard motors OM is driven forward, and the other outboard motor OM is driven in reverse. Thus, the two outboard motors OM apply a moment to the hull 2 about the turning center 70 in one of opposite directions (in the clockwise direction in FIG. 6D or in the counterclockwise direction in FIG. 6E). More specifically, the two outboard motors OM apply the moment to the hull 2 in the same direction as the bow thruster BT to promote the bow turning of the hull 2. When the bow of the hull 2 is turned, the moment may be applied to the hull 2 in a direction opposite to the bow turning direction for braking.

In the example of the bow thruster mode shown in FIGS. 6A to 6C, the steering angles of the outboard motors OM are set to zero. Alternatively, the steering angles of the outboard motors OM may be adjusted for the azimuth control. In another example of the bow thruster mode, not only the propulsive force of the bow thruster BT but also the propulsive forces of the outboard motors OM may be contributable to the adjustment of the azimuth. In this case, also, the two outboard motors OM are both driven forward (see FIG. 6A), are both stopped (in the neutral state) (see FIG. 6B), or are both driven in reverse (see FIG. 6C). Further, only one of the outboard motors OM may generate the propulsive force. In this case, the other outboard motor OM is stopped.

In the bow thruster mode, there is no need to allocate a greater proportion of the propulsive forces of the outboard motors OM for the adjustment of the azimuth of the hull 2. Therefore, the propulsive forces of the outboard motors OM can be mostly used for the position control, or the generation of the propulsive forces may be stopped to improve the quietness of the watercraft. Particularly, the shift-in occurs less frequently to improve the quietness of the watercraft.

Figure 7:
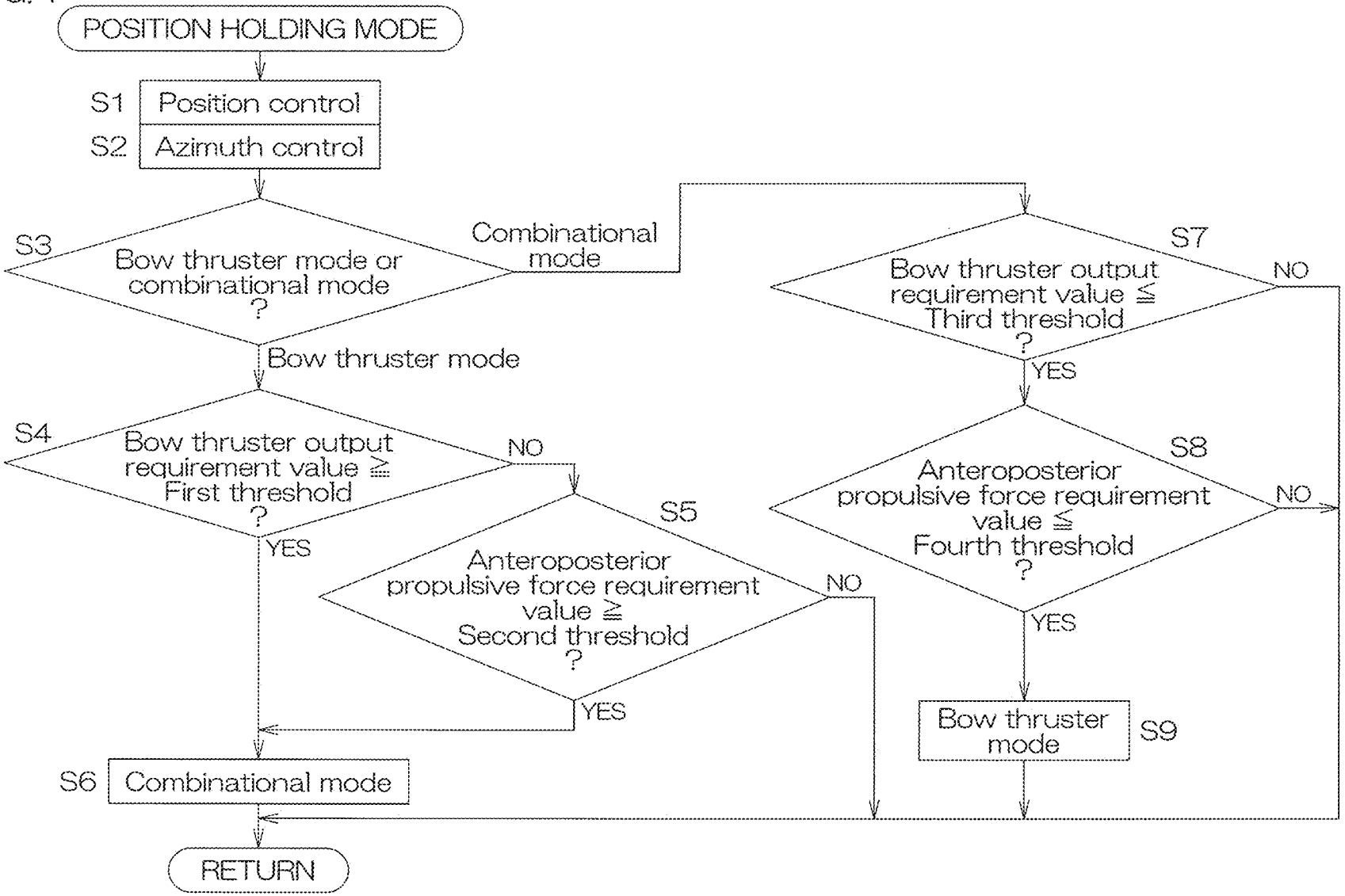
FIG. 7 is a flowchart for describing the features of a position holding mode.

FIG. 7 is a flowchart for describing the features of the position holding mode (Fish Point™). In the position holding mode, an automatic watercraft maneuvering control is performed to hold the position of the hull 2 with the bow or the stern of the hull 2 directed against the movement direction of the hull 2. If the holding mode setting button 183 for the position holding mode is operated, the main controller 50 acquires information of the current position of the hull 2 from the GPS receiver 52 to set the current position as a target position, and performs the position control to maintain the hull 2 at the target position (Step S1). Further, the main controller 50 determines the movement direction of the hull 2 based on the position data and/or the speed data outputted from the GPS receiver 52, and sets a direction against the movement direction as a target azimuth. The main controller 50 performs the azimuth control so that the hull azimuth (bow azimuth) detected by the azimuth sensor 53 matches with the target azimuth or an azimuth obtained by inverting the target azimuth by 180 degrees (hereinafter, these azimuths are both defined as the target azimuth in the position holding mode) (Step S2).

In the azimuth control, the main controller 50 switches the control mode between the bow thruster mode and the combinational mode based on a predetermined switching condition (a mode transition condition). The initial mode may be the bow thruster mode. The switching condition includes a combinational mode switching condition to switch from the bow thruster mode to the combinational mode (Steps S4 and S5). Further, the switching condition includes a bow thruster mode switching condition to switch from the combinational mode to the bow thruster mode (Steps S7 and S8).

The combinational mode switching condition includes at least one of the following first or second switching conditions. In this preferred embodiment, the combinational mode switching condition includes both the first switching condition and the second switching condition. The determination on the first switching condition and the determination on the second switching condition may be carried out substantially simultaneously, or either one of the determinations may precede the other.

First switching condition: An output requirement value for the bow thruster BT is not less than a first threshold (Step S4).

Second switching condition: A propulsive force requirement value for anteroposterior propulsive forces to be generated anteroposteriorly of the hull 2 is not less than a second threshold (Step S5).

If at least one of the first switching condition or the second switching condition is satisfied (YES in Step S4 or S5) in the bow thruster mode (when the process is branched to Step S4 from Step S3), the main controller 50 switches the bow thruster mode to the combinational mode (Step S6).

The bow thruster mode switching condition includes at least one of the following third or fourth switching conditions. In this preferred embodiment, the bow thruster mode switching condition includes both the third switching condition and the fourth switching condition. The determination on the third switching condition and the determination on the fourth switching condition may be carried out substantially simultaneously, or either one of the determinations may precede the other.

Third switching condition: The output requirement value for the bow thruster BT is not greater than a third threshold (Step S7).

Fourth switching condition: The propulsive force requirement value for the anteroposterior propulsive forces to be generated anteroposteriorly of the hull 2 is not greater than a fourth threshold (Step S8).

If the third switching condition and the fourth switching condition are both satisfied (YES in Step S7 and YES in Step S8) in the combinational mode (when the process is branched to Step S7 from Step S3), the main controller 50 switches the combinational mode to the bow thruster mode (Step S9).

In the bow thruster mode, the main controller 50 applies the propulsive force command to the motor controller 43 so as to reduce the offset of the detection azimuth detected by the azimuth sensor 53 from the target azimuth. The propulsive force command includes the shift command (rotation direction command) and the output command (rotation speed command). The value of the output command corresponds to the output requirement value. As the offset of the detection azimuth from the target azimuth increases, the output requirement value for the bow thruster BT is increased. If the offset is not reduced due to the influence of the external disturbance even by driving the bow thruster BT, the output requirement value is increased by feedback control.

In the bow thruster mode, the main controller 50 also performs the position control so as to maintain the position of the hull 2 by the forward driving or the reverse driving of both the two outboard motors OM (see FIGS. 6A to 6C). That is, the azimuth of the hull 2 is maintained in a direction against the external disturbance (wind, tidal current and the like) by the bow thruster BT, and the position of the hull 2 is maintained by applying the forward or reverse propulsive forces of the outboard motors OM to the hull 2 in that direction. The main controller 50 applies the propulsive force command to the outboard motors OM so that the actual position (detection position) of the hull 2 outputted by the GPS receiver 52 matches with the target position. The propulsive force command includes the shift command (shift position command) and the output command (propulsive force magnitude command). The value of the output command corresponds to the propulsive force requirement value for the anteroposterior propulsive forces to be applied anteroposteriorly of the hull 2. As the offset of the detection position from the target position increases, the propulsive force requirement value for the anteroposterior propulsive forces is increased. If the positional offset is not reduced even by driving the outboard motors OM, the propulsive force requirement value is increased by feedback control. Since the azimuth adjustment can be achieved by the bow thruster BT, the propulsive forces of the outboard motors OM can be mostly used for the position adjustment. Thus, the position can be highly precisely maintained.

In the combinational mode, the main controller 50 controls the two outboard motors OM to drive one of the two outboard motors OM forward and drive the other outboard motor OM in reverse to apply a moment to the hull 2 about the turning center 70 by the propulsive forces of the outboard motors OM, thus assisting the bow turning of the hull 2 (see FIGS. 6D and 6E). The main controller 50 also performs the position control to maintain the position of the hull 2 by the propulsive forces of the two outboard motors OM. That is, the propulsive forces of the outboard motors OM are partially used for the bow turning of the hull 2, and the rest of the propulsive forces of the outboard motors OM is used to apply the anteroposterior propulsive forces to the hull 2. Thus, the azimuth of the hull 2 is maintained in the direction against the external disturbance by utilizing the propulsive force of the bow thruster BT and the propulsive forces of the outboard motors OM in combination, and the position of the hull 2 is maintained by applying the forward or reverse propulsive forces of the outboard motors OM to the hull 2 in that direction. The main controller 50 sets the output command so as to make up for the moment which may otherwise be insufficient only with the propulsive force of the bow thruster BT and to match the detection position with the target position, and applies the propulsive force command to the outboard motors OM. In the combinational mode, a greater moment can be applied to the hull 2 by utilizing both the bow thruster BT and the outboard motors OM making it possible to properly maintain the azimuth of the hull 2.

The switching between the bow thruster mode and the combinational mode properly occurs according to the determination based on the first to fourth thresholds such that the azimuth control and the position control can be highly precisely performed.

The first threshold is preferably not less than the third threshold. Where the first threshold is greater than the third threshold, hysteresis can be introduced into the mode switching. Similarly, the second threshold is preferably not less than the fourth threshold. Where the second threshold is greater than the fourth threshold, hysteresis can be introduced into the mode switching.

Figure 8:
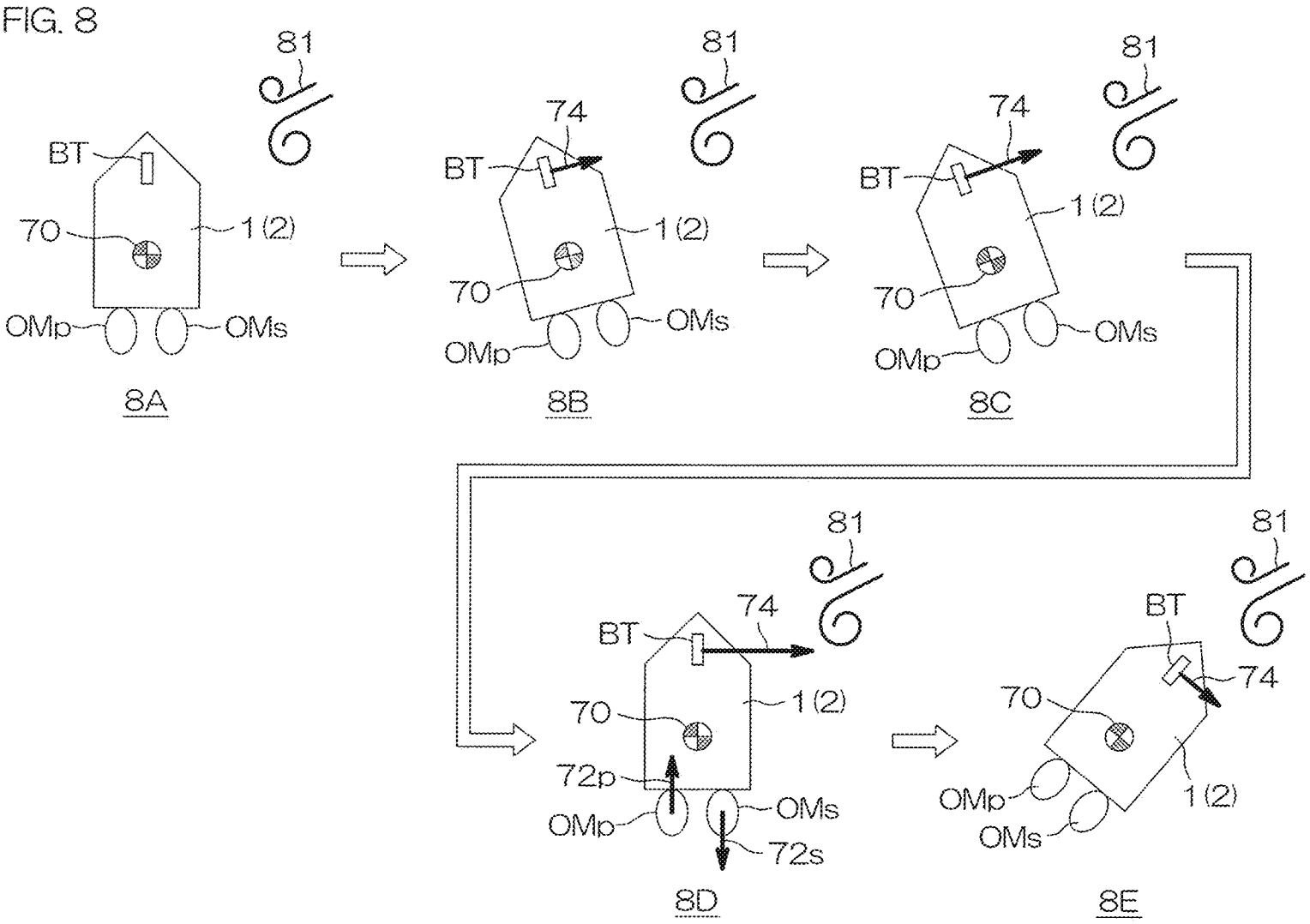
FIG. 8 shows an exemplary operation to be performed in the position holding mode.

FIG. 8 shows an exemplary operation to be performed in the position holding mode (Fish Point™), mainly showing an exemplary operation to be performed to eliminate the azimuthal offset. If the position holding mode is started by operating the holding mode setting button 183, the direction of the external disturbance 81 (wind, tidal current and the like) is estimated based on the positional offset of the hull 2 due to the external disturbance 81 (State 8A). Then, the direction against the external disturbance 81 is set as the target azimuth, and the bow turning of the hull 2 toward the target azimuth is started (State 8B). For example, the initial mode is the bow thruster mode, so that the bow thruster BT applies a moment to the hull 2 in the direction against the external disturbance 81. The output requirement value for the bow thruster BT is feedback-controlled based on the offset of the detection azimuth from the target azimuth.

If a state such that the azimuthal offset cannot be eliminated only by the propulsive force of the bow thruster BT continues (State 8C), the first switching condition is satisfied, and the bow thruster mode is switched to the combinational mode. Then, one of the two outboard motors OM is driven forward and the other outboard motor OM is driven in reverse such that a moment is applied to the hull 2 in the same direction as the moment applied by the bow thruster BT (State 8D). Thus, a greater bow turning moment acts on the hull 2 and, therefore, the azimuthal offset is gradually eliminated. Thus, the output requirement value for the bow thruster BT is reduced, so that the third switching condition is satisfied. If the fourth switching condition is also satisfied, the combinational mode is switched to the bow thruster mode (State 8E).

Figure 9:
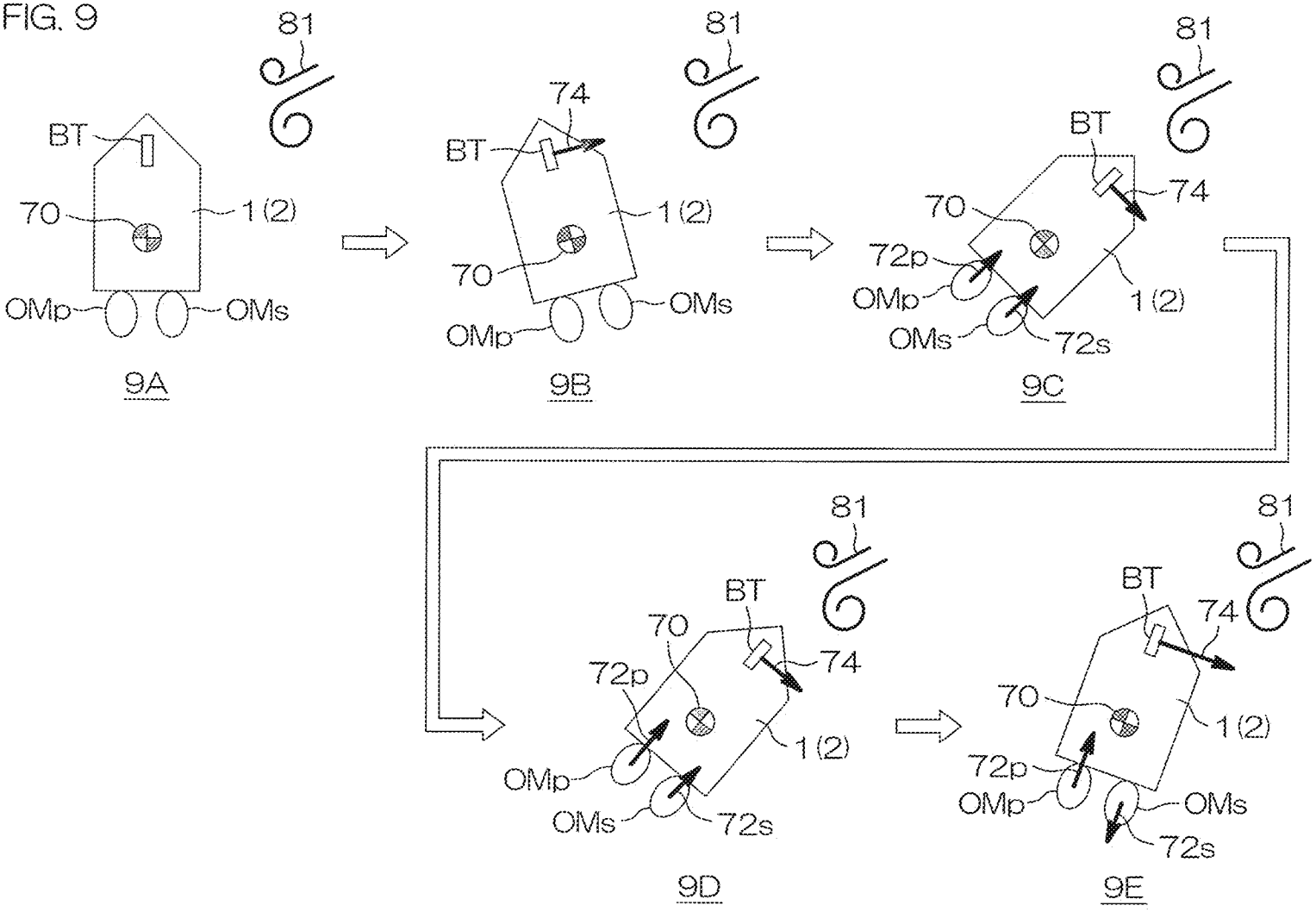
FIG. 9 shows another exemplary operation to be performed in the position holding mode.

FIG. 9 shows another exemplary operation to be performed in the position holding mode (Fish Point™), mainly showing an exemplary operation to be performed to eliminate the positional offset. If the position holding mode is started by operating the holding mode setting button 183, the direction of the external disturbance 81 (wind, tidal current and the like) is estimated based on the positional offset of the hull 2 due to the external disturbance 81 (State 9A). Then, the direction against the external disturbance 81 is set as the target azimuth, and the bow turning of the hull 2 toward the target azimuth is started (State 9B). For example, the initial mode is the bow thruster mode, so that the bow thruster BT applies a moment to the hull 2 in the direction against the external disturbance 81. When the hull 2 is directed in the direction against the external disturbance 81 (when the azimuth of the hull 2 reaches the target azimuth) (State 9C), the position of the hull 2 is offset from the target position anteroposteriorly of the hull 2. This positional offset is compensated for by the propulsive forces of the outboard motors OM. If the external disturbance 81 is great, the propulsive force requirement value for the anteroposterior propulsive forces is increased by feedback control (State 9D). If the second switching condition is satisfied, the bow thruster mode is switched to the combinational mode (State 9E).

The studies conducted by the inventors reveal that, where the anteroposterior propulsive forces generated by the outboard motors OM are increased, the bow turning of the hull by the bow thruster BT is less efficient. Therefore, if the propulsive force requirement value for the anteroposterior propulsive forces is increased and the second switching condition is satisfied, the bow thruster mode is switched to the combinational mode. In the combinational mode, the propulsive forces of the outboard motors OM are used for the elimination of the anteroposterior positional offset of the hull 2, and are also used for the adjustment of the azimuth of the hull 2. Thus, even if relatively great anteroposterior propulsive forces are generated, a necessary moment can be applied to the hull 2 by the propulsive forces of both the bow thruster BT and the outboard motors OM to improve the azimuth holding performance. If the positional offset is eliminated and the azimuthal offset is reduced by the combinational mode, the third switching condition and the fourth switching condition are both satisfied and, therefore, the combinational mode is switched to the bow thruster mode.

In the combinational mode, the propulsive forces generated by the outboard motors OM are partially used to apply the moment to the hull 2 and, therefore, the anteroposterior propulsive forces are reduced. However, the bow thruster BT also generates the propulsive force to apply the moment to the hull 2, so that a relatively small proportion of the propulsive forces of the outboard motors OM is allocated for the bow turning of the hull 2. In the combinational mode, also, it is possible to apply a greater bow turning moment to the hull 2 while providing a sufficient position holding performance. In the non-cooperative mode, the propulsive force of the bow thruster BT is not utilized, so that a greater proportion of the propulsive forces of the outboard motors OM is allocated for the bow turning of the hull 2. Therefore, the hull position holding performance is lower in the non-cooperative mode than in the cooperative mode.

In one example of the bow thruster mode, as described above, the propulsive forces of the outboard motors OM are not contributable to the bow turning of the hull 2. In another example of the bow thruster mode, on the other hand, the propulsive forces of the outboard motors OM may be utilized to apply the anteroposterior propulsive forces to the hull 2 and to apply the moment to the hull 2. For example, the propulsive forces of the two outboard motors OM having different magnitudes may be directed parallel or substantially parallel to each other to apply the moment to the hull 2. Further, the two outboard motors OM may be steered with the propulsive forces thereof directed parallel or substantially parallel to each other to apply the moment to the hull 2. In the bow thruster mode, the two outboard motors OM can be used for the adjustment of the azimuth of the hull 2 by thus controlling the propulsive forces and/or the steering angles of the two outboard motors OM.

Figure 10:
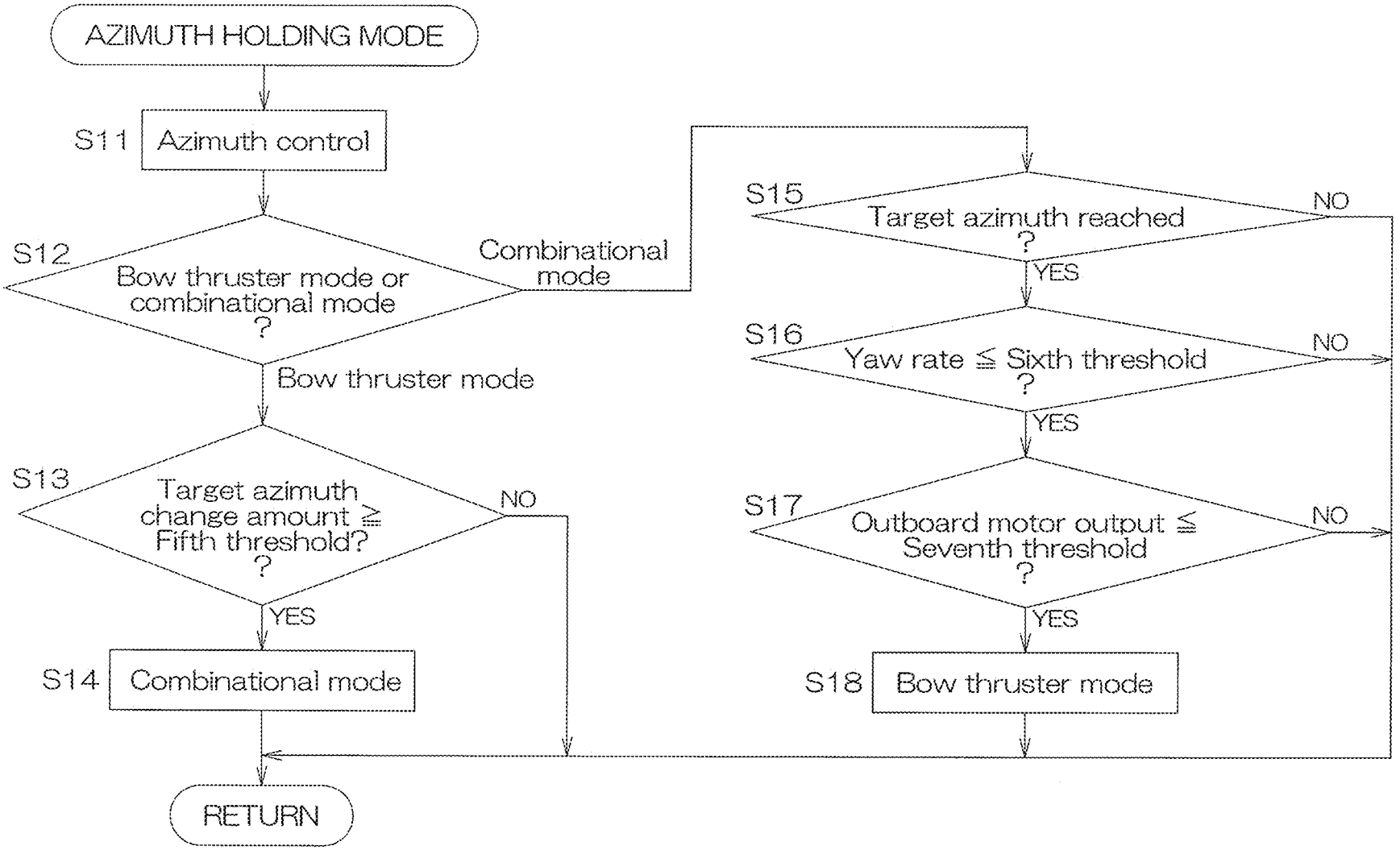
FIG. 10 is a flowchart for describing the features of an azimuth holding mode.

FIG. 10 is a flowchart for describing the features of the azimuth holding mode (Drift Point™). The azimuth holding mode is adapted for the automatic watercraft maneuvering operation in which the bow azimuth (or the stern azimuth) is maintained and the hull position is not maintained. If the holding mode setting button 184 for the azimuth holding mode is operated, the main controller 50 acquires information of a current azimuth from the azimuth sensor 53 to set the current azimuth as the target azimuth, and performs the azimuth control to maintain the hull 2 at the target azimuth (Step S11). The target azimuth can be changed (finely adjusted), for example, by operating the input device 10 of the gauge 9 (target azimuth changing function). In this case, the input device 10 is an example of the target azimuth setter. Alternatively, the target azimuth changing function (target azimuth fine adjustment function) may be assigned to one of the function switches 61. In this case, the function switch 61 is an example of the target azimuth setter.

In this example, the azimuth control in the azimuth holding mode is basically performed in the bow thruster mode as described above and, even if the combinational mode switching condition is satisfied, the bow thruster mode is not switched to the combinational mode.

If the target azimuth changing operation is performed, however, the bow thruster mode is exceptionally switched to the combinational mode.

Specifically, it is herein assumed, for example, that the setting of the target azimuth is changed by operating the input device 10 (the target azimuth setter) in the bow thruster mode (when the process is branched to Step S13 from Step S12). If a difference between the changed target azimuth and the previous target azimuth, i.e., the amount of the change in the target azimuth, is not less than the fifth threshold (Step S13), the bow thruster mode is switched to the combinational mode (Step S14).

In the combinational mode (when the process is branched to Step S15 from Step S12), the bow azimuth thereafter reaches the changed target azimuth by the bow turning of the hull 2 (YES in Step S15). At this time, if the yaw rate of the hull 2 is not greater than a sixth threshold (YES in Step S16) and the outputs of the two outboard motors OM are not greater than a seventh threshold (YES in Step S17), the combinational mode is switched back to the bow thruster mode (Step S18). Thus, the bow of the hull 2 can be speedily turned by utilizing the propulsive forces of the outboard motors OM so that the hull 2 can be speedily pointed at the target azimuth set by the user.

Where the mode switching condition is such that the yaw rate of the hull 2 is not greater than the sixth threshold (Step S16) and the outputs of the outboard motors OM are not greater than the seventh threshold (Step S17), the combinational mode can be smoothly switched to the bow thruster mode and the azimuth can be easily maintained in the bow thruster mode.

The main controller 50 may determine the yaw rate of the hull 2, for example, by differentiating the detection azimuth of the azimuth sensor 53. Of course, a yaw rate sensor may be provided, and the output of the yaw rate sensor may be used.

If the first switching condition (see Step S4 in FIG. 7) is satisfied in the bow thruster mode, for example, the bow thruster mode may be switched to the combinational mode. Further, if the third switching condition (see Step S8 in FIG. 7) is satisfied in the combinational mode, the combinational mode may be switched back to the bow thruster mode.

Figure 11:
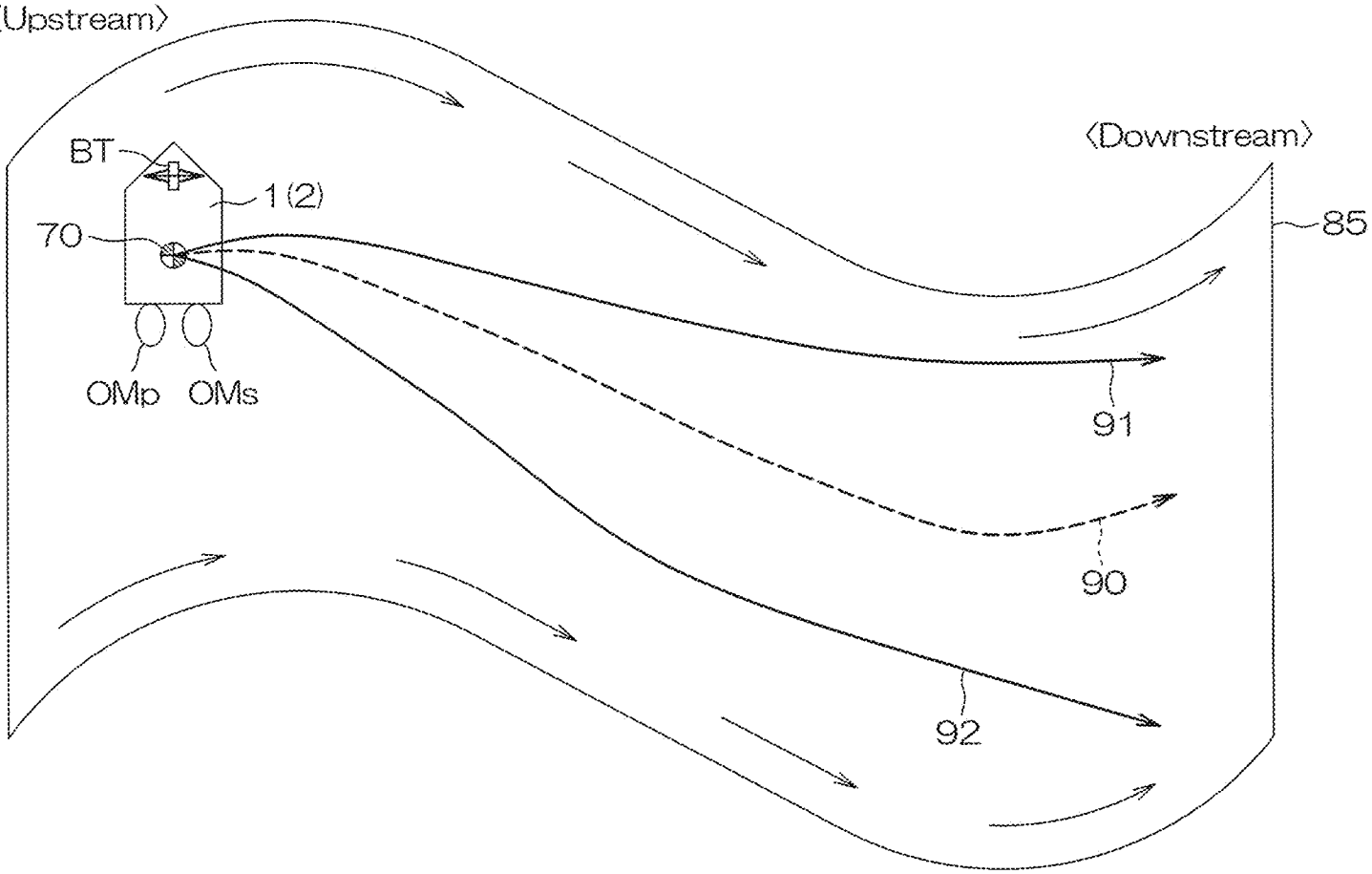
FIG. 11 is a diagram for describing an exemplary hull behavior to be observed in the azimuth holding mode when the bow thruster mode is utilized.

FIG. 11 is a diagram for describing an exemplary hull behavior to be observed in the azimuth holding mode where the bow thruster mode is utilized. The azimuth holding mode is typically utilized, for example, for trolling, when the hull 2 is moved along tidal current 85 with the azimuth of the hull 2 maintained. Since the moment is applied to the hull 2 only by the propulsive forces of the outboard motors OM in the non-cooperative mode, the hull 2 often receives not only the moment but also the anteroposterior propulsive forces. It is ideal that the hull 2 is moved along a route 90 on the tidal current 85 but, actually, the hull 2 is often moved along a route 91 or a route 92 anteroposteriorly deviated from the route 90. In the cooperative mode, in contrast, the azimuth control is performed according to the bow thruster mode, so that the azimuth of the hull 2 can be maintained substantially without applying the anteroposterior propulsive forces to the hull 2. Thus, the hull 2 can be moved substantially along the ideal route 90.

In the bow thruster mode, the azimuth is adjusted by utilizing the propulsive force of the bow thruster BT, so that the outboard motors OM do not need to generate the propulsive forces. This improves the quietness in the azimuth holding mode, and provides a watercraft driving state suitable for the trolling. With the outboard motors OM kept in a stop state (in an idling state), it is possible to reduce the actuation noises of the shift mechanisms 24 and to reduce vibrations attributable to the shift-in of the shift mechanisms 24.

Figure 12:
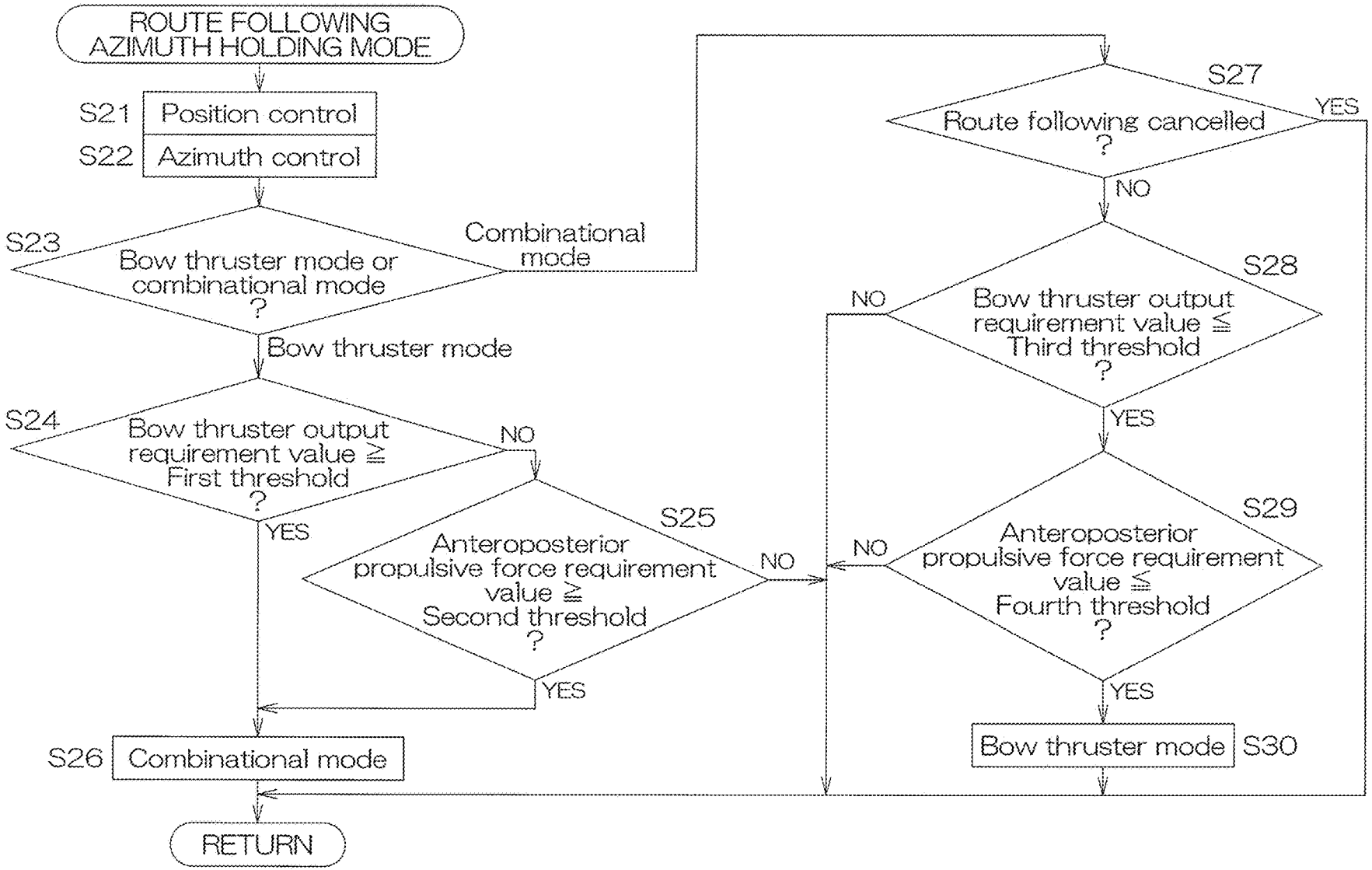
FIG. 12 is a flowchart for describing the features of a route following azimuth holding mode.

FIG. 12 is a flowchart for describing the features of a hull movement route setting operation in the azimuth holding mode (Drift Point™). After the route following mode (Track Point™) is selected by operating the corresponding one of the function switches 61 on the application switch panel 60 with the azimuth holding mode effected by operating the holding mode setting button 184 for the azimuth holding mode, the user can specify a sailing route. Specifically, the user can specify a plurality of checkpoints, for example, by operating the input device 10 of the gauge 9 to specify a course (route) passing through the plurality of checkpoints. The main controller 50 performs a control operation for an automatic watercraft maneuvering mode (Drift Point Track™) to maintain the position of the hull 2 on the specified route and maintain the bow azimuth. This automatic watercraft maneuvering mode is hereinafter referred to as "route following azimuth holding mode."

In the route following azimuth holding mode, the main controller 50 acquires the position information of the hull 2 from the GPS receiver 52, and performs the position control (route following control) to maintain the position of the hull 2 on the specified sailing route (Step S21). In the route following azimuth holding mode, the main controller 50 acquires the information of the current azimuth from the azimuth sensor 53 to set the current azimuth as the target azimuth, and performs the azimuth control to maintain the azimuth of the hull 2 at the target azimuth (Step S22).

In the route following azimuth holding mode, therefore, the position control and the azimuth control are performed as in the position holding mode (Fish Point™). The azimuth control is performed in substantially the same manner as in the position holding mode. That is, the initial mode is, for example, the bow thruster mode. If at least one of the first switching condition (Step S24) and the second switching condition (Step S25) is satisfied in the bow thruster mode (when the process is branched to Step S24 from Step S23), the bow thruster mode is switched to the combinational mode (Step S26). If the third switching condition (Step S28) and the fourth switching condition (Step S29) are both satisfied in the combinational mode (when the process is branched to Step S27 from Step S23), the combinational mode is switched to the bow thruster mode (Step S30). However, if the route following azimuth holding mode is switched to the ordinary azimuth holding mode by cancelling the route following control in the route following azimuth holding mode (YES in Step S27), the combinational mode is switched to the bow thruster mode (Step S30) whether the third switching condition and the fourth switching condition are satisfied or not. Thereafter, the control operation is performed for the azimuth holding mode (see FIG. 10).

In the route following azimuth holding mode, the steering angles of the two outboard motors OM are set to zero, and the two outboard motors OM apply the propulsive forces to the hull 2 in the forward or reverse direction along the center line 2*a* as in the position holding mode. In the bow thruster mode, the two outboard motors OM are both driven forward, are both stopped (in the neutral state), or are both driven in reverse. Thus, the position of the hull 2 is maintained on the specified route. In the combinational mode, one of the two outboard motors OM is driven forward, and the other outboard motor OM is driven in reverse. Thus, the two outboard motors OM apply a moment to the hull 2 in one of opposite directions (in the clockwise direction or in the counterclockwise direction) about the turning center. More specifically, the two outboard motors OM apply the moment to the hull 2 in the same direction as the bow thruster BT to promote the bow turning of the hull 2.

In the route following azimuth holding mode, the position of the hull 2 is anteroposteriorly changed by utilizing the propulsive forces of the outboard motors OM. Where the anteroposterior propulsive forces are great, the bow turning performance of the bow thruster BT is deteriorated. In order to compensate for the deterioration of the bow turning performance, therefore, the bow thruster mode is switched to the combinational mode. Thus, the propulsive forces of the outboard motors OM are also utilized for the bow turning of the hull 2.

As in the azimuth holding mode, the target azimuth may be changeable, for example, by operating the input device 10 of the gauge 9 or the corresponding one of the function switches 61 (target azimuth changing function). In this case, if the first switching condition (Step S24) or the second switching condition (Step S25) is satisfied due to the change in the target azimuth, the bow thruster mode is switched to the combinational mode (Step S26). After the switching to the combinational mode, if the third switching condition (Step S28) and the fourth switching condition (Step S29) are both satisfied, the combinational mode is switched to the bow thruster mode (Step S30). When the target azimuth is changed, the mode may be switched between the bow thruster mode and the combinational mode in the same manner as shown in FIG. 10.

Figure 13:
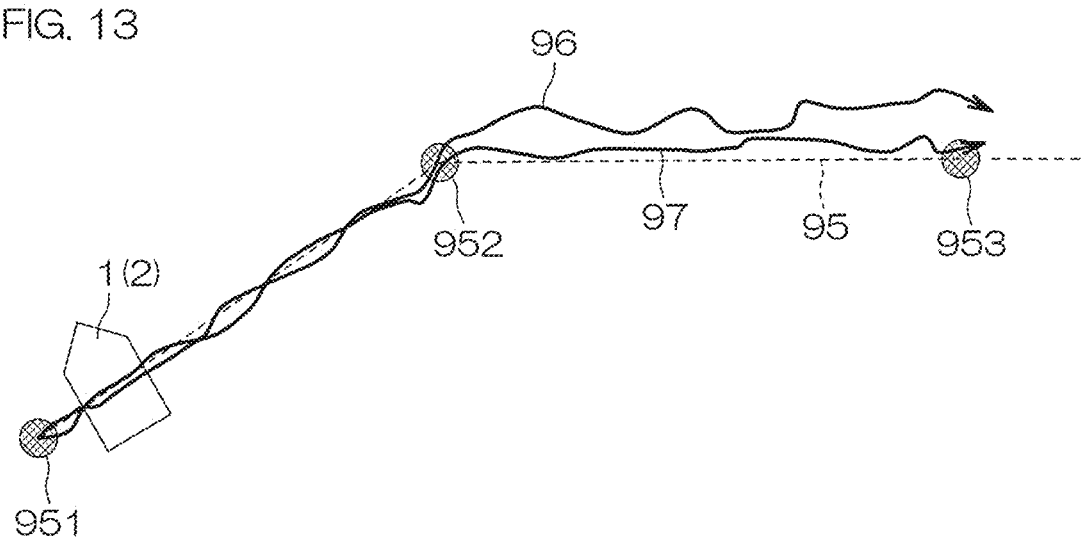
FIG. 13 shows a comparison between the non-cooperative mode and the cooperative mode in the route following azimuth holding mode.

FIG. 13 shows a comparison between the non-cooperative mode and the cooperative mode in the route following azimuth holding mode. In the non-cooperative mode, the propulsive forces of the outboard motors OM are utilized to apply the moment to the hull 2 so as to maintain the azimuth of the hull 2, and the propulsive forces of the outboard motors OM are also utilized for the anteroposterior position control of the hull 2. Therefore, the propulsive forces for the position control are often insufficient such that the course of the hull 2 is liable to be significantly deviated from the specified route 95 as indicated by a reference character 96. In the cooperative mode, the control operation is performed dominantly in the bow thruster mode, in which the azimuth of the hull 2 is controlled by utilizing the bow thruster BT and the position of the hull 2 is controlled by utilizing the outboard motors OM. Thus, the course of the hull 2 can precisely follow the specified route 95 as indicated by a reference character 97. Reference characters 951, 952, 953 indicate the checkpoints that define the specified route 95.

Figure 14:
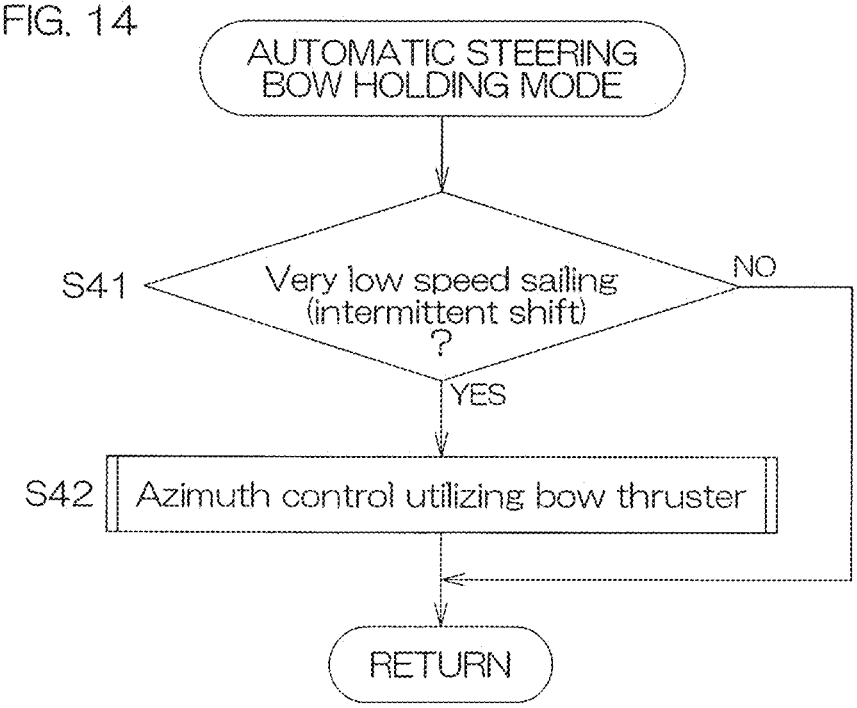
FIG. 14 is a flowchart for describing the features of an azimuth control during an automatic steering operation.

FIG. 14 is a flowchart for describing the features of the azimuth control during an automatic steering operation. Here, the description will be given to an example of the azimuth control for the automatic steering operation to be performed according to the bow holding mode (Heading Hold) to maintain the azimuth of the hull 2 in the cooperative mode. If the sailing speed of the watercraft 1 is sufficiently high, the watercraft 1 can be sailed forward with the azimuth of the hull 2 maintained by steering the outboard motors OM. If the sailing speed of the watercraft 1 is not higher than a predetermined speed level (e.g., 5 km/h) for very low speed sailing, the shift mechanisms 24 of the outboard motors OM are intermittently shifted in such that an intermittent shift operation is performed to intermittently transmit the powers of the engines 23 to the propellers 20. The outboard motors OM do not generate the propulsive forces during a period in which the powers are not transmitted to the propellers 20. Therefore, the outboard motors OM cannot effectively apply the bow turning moment to the hull 2 even if being steered.

Therefore, if the sailing speed is reduced to not higher than the predetermined speed level (or if the intermittent shift operation is started) (YES in Step S41), the main controller 50 drives the bow thruster BT to perform the azimuth control (Step S42). The bow of the hull 2 can be turned by driving the bow thruster BT whether the shift mechanisms 24 are in the shift-in state or in the shift-out state, i.e., whether or not the propulsive forces of the outboard motors OM are transmitted to the hull 2. Thus, the azimuth of the hull 2 can be maintained at the target azimuth.

The azimuth control adapted to maintain the bow azimuth according to the bow holding mode during forward sailing at a very low speed may be performed only in the bow thruster mode. As in the position holding mode (see FIG. 7), the mode may be switched between the bow thruster mode and the combinational mode according to the first to fourth switching conditions. If the bow cannot be pointed at the target azimuth due to the external disturbance only by the propulsive force of the bow thruster BT during the very low speed sailing, the bow thruster mode may be switched to the combinational mode. This makes it easier to maintain the bow azimuth.

FIG. 15 is a diagram for describing the features of the setting of the output level of the bow thruster BT. The user can set the output level (upper output limit) of the bow thruster BT, for example, by operating the input device 10. Thus, the user can adjust the bow turning moment to be generated by the bow thruster BT as intended. In this example, the output level (Lv) can be set on a scale of Levels 1 to 5, and can be switched among three sublevels (Low, Medium and High) for each level. Numerals in FIG. 15 each represent the output level of the bow thruster with respect to a maximum level of 100%. In this preferred embodiment, the input device 10 is an example of the upper output limit setter.

The main controller 50 applies the propulsive force command to the motor controller 43 of the bow thruster BT so as to drive the bow thruster BT based on the output level thus set as the upper limit.

Where the output level is set to High of Level 5, the bow thruster BT is controlled so as to utilize an output level up to the maximum output level (100%) of the bow thruster BT. Since a greater bow turning moment can be provided by thus utilizing the bow thruster BT, an excellent maneuverability can be provided. On the other hand, the power consumption of the electric motor 42 of the bow thruster BT is increased, so that a battery (not shown) is exhausted in a shorter period of time. Further, the heat generation of the electric motor 42 is increased.

Where the output level is set to Low of Level 1, the upper output limit of the bow thruster BT is low, so that the bow thruster BT generates a smaller bow turning moment. On the other hand, the power consumption of the bow thruster BT and the heat generation of the electric motor 42 can be reduced. Therefore, the usable period (operation period) of the bow thruster BT can be advantageously increased.

In this preferred embodiment, the first threshold for the first switching condition is changed in association with the setting of the output level of the bow thruster BT. That is, as the output level increases, the first threshold is set to a higher level. In this preferred embodiment, the third threshold for the third switching condition is also changed in association with the setting of the output level of the bow thruster BT. That is, as the output level increases, the third threshold is set to a higher level. By thus automatically changing the first threshold and/or the third threshold according to the setting of the output level, the mode can be switched between the bow thruster mode and the combinational mode without a user's additional setting operation, and the azimuth control can be performed highly precisely.

While preferred embodiments of the present invention have thus been described, the present invention may be embodied in some other ways.

In a preferred embodiment described above, the two outboard motors OM are provided on the stern 3 by way of example. The number of the outboard motors OM may be one, or three or more. In a preferred embodiment described above, the engine outboard motors are used as the propulsion devices by way of example, but instead electric outboard motors may be employed. Further, the propulsion devices are not necessarily required to be the outboard motors, but may be inboard motors, inboard/outboard motors (stern drives), waterjet propulsion devices and other types of propulsion devices.

In a preferred embodiment described above, the bow thruster BT is able to generate the propulsive force only laterally leftward and rightward by way of example. Alternatively, a steerable propulsion device such as an electric trolling motor may be provided at the bow instead of the propulsion device that is able to generate the propulsive force only laterally leftward and rightward. That is, the bow thruster may be a propulsion device provided at the bow and able to generate the propulsive force laterally leftward and rightward and further generate the propulsive force in directions other than the leftward and rightward directions.

In a preferred embodiment described above, the watercraft propulsion system 100 includes the cooperative mode in which the outboard motors OM and the bow thruster BT are controlled in a cooperative manner, and the non-cooperative mode in which the cooperative control is not performed by way of example. However, the non-cooperative mode may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a bow thruster at a bow of a hull to generate a lateral propulsive force;

at least two propulsion devices on a stern of the hull each having a variable steering angle; and a controller configured or programmed to control the propulsive force of the bow thruster, and control propulsive forces and the steering angles of the two propulsion devices to perform an azimuth control to control an azimuth of the hull; wherein the azimuth control includes a bow thruster mode in which the propulsive force of the bow thruster is controlled to adjust the hull azimuth, and a combinational mode in which the propulsive force of the bow thruster is controlled and the two propulsion devices are driven forward and in reverse, respectively, to adjust the hull azimuth;

the controller is configured or programmed to switch between the bow thruster mode and the combinational mode based on a predetermined switching condition during the azimuth control;

propulsive forces generated by the two propulsion devices in the bow thruster mode do not contribute to the adjustment of the hull azimuth;

the switching condition includes a combinational mode switching condition to switch from the bow thruster mode to the combinational mode, and the combinational mode switching condition includes at least one of a first switching condition such that an output requirement value for the bow thruster is not less than a first threshold or a second switching condition such that a propulsive force requirement value for anteroposterior propulsive forces to be generated anteroposteriorly of the hull is not less than a second threshold; and the switching condition includes a bow thruster mode switching condition to switch from the combinational mode to the bow thruster mode, and the bow thruster mode switching condition includes at least one of a third switching condition such that an output requirement value for the bow thruster is not greater than a third threshold or a fourth switching condition such that a propulsive force requirement value for anteroposterior propulsive forces to be generated anteroposteriorly of the hull is not greater than a fourth threshold.

2. The watercraft propulsion system according to claim 1, wherein the bow thruster mode is switched to the combinational mode if at least one of the first switching condition or the second switching condition is satisfied.

3. The watercraft propulsion system according to claim 1, wherein the combinational mode is switched to the bow thruster mode if both the third switching condition and the fourth switching condition are satisfied.

4. The watercraft propulsion system according to claim 1, further comprising:

an upper output limit setter to be operated by a user to set an upper output limit of the bow thruster; wherein the first threshold for the first switching condition is variably set based on the upper output limit set by the upper output limit setter.

5. A watercraft propulsion system comprising:

a bow thruster at a bow of a hull to generate a lateral propulsive force;

at least two propulsion devices on a stern of the hull each having a variable steering angle; and a controller configured or programmed to control the propulsive force of the bow thruster, and control propulsive forces and the steering angles of the two propulsion devices to perform an azimuth control to control an azimuth of the hull; wherein the azimuth control includes a bow thruster mode in which the propulsive force of the bow thruster is controlled to adjust the hull azimuth, and a combinational mode in which the propulsive force of the bow thruster is controlled and the two propulsion devices are driven forward and in reverse, respectively, to adjust the hull azimuth;

the controller is configured or programmed to switch between the bow thruster mode and the combinational mode based on a predetermined switching condition during the azimuth control;

the switching condition includes a bow thruster mode switching condition to switch from the combinational mode to the bow thruster mode, and the bow thruster mode switching condition includes at least one of a third switching condition such that an output requirement value for the bow thruster is not greater than a third threshold or a fourth switching condition such that a propulsive force requirement value for anteroposterior propulsive forces to be generated anteroposteriorly of the hull is not greater than a fourth threshold;

the watercraft propulsion system further comprises an upper output limit setter to be operated by a user to set an upper output limit of the bow thruster; and the third threshold for the third switching condition is variably set based on the upper output limit set by the upper output limit setter.

6. The watercraft propulsion system according to claim 1, wherein the controller is configured or programmed to perform the azimuth control during an automatic watercraft maneuvering control in which a position of the hull is maintained with the bow or the stern of the hull directed against a movement direction of the hull.

7. The watercraft propulsion system according to claim 1, wherein the controller is configured or programmed to perform the azimuth control during an automatic watercraft maneuvering control in which a position of the hull is not maintained and a bow azimuth of the hull is maintained at a target azimuth.

8. A watercraft propulsion system comprising:

a bow thruster at a bow of a hull to generate a lateral propulsive force;

at least two propulsion devices on a stern of the hull each having a variable steering angle; and a controller configured or programmed to control the propulsive force of the bow thruster, and control propulsive forces and the steering angles of the two propulsion devices to perform an azimuth control to control an azimuth of the hull; wherein the azimuth control includes a bow thruster mode in which the propulsive force of the bow thruster is controlled to adjust the hull azimuth, and a combinational mode in which the propulsive force of the bow thruster is controlled and the two propulsion devices are driven forward and in reverse, respectively, to adjust the hull azimuth;

the controller is configured or programmed to switch between the bow thruster mode and the combinational mode based on a predetermined switching condition during the azimuth control;

the controller is configured or programmed to perform the azimuth control during an automatic watercraft maneuvering control in which a position of the hull is not maintained and a bow azimuth of the hull is maintained at a target azimuth the watercraft propulsion system further comprises a target azimuth setter to be operated by a user to set the target azimuth;

the bow thruster mode is switched to the combinational mode if an amount of a change in the target azimuth set by the target azimuth setter is not less than a fifth threshold; and the combinational mode is switched to the bow thruster mode if a yaw rate of the hull is not greater than a sixth threshold and outputs of the two propulsion devices are not greater than a seventh threshold after the bow azimuth reaches the target azimuth.

9. The watercraft propulsion system according to claim 1, wherein the controller is configured or programmed to perform the azimuth control during an automatic watercraft maneuvering control in which a position of the hull is maintained on a specified route and a bow azimuth of the hull is maintained at a target azimuth.

10. The watercraft propulsion system according to claim 1, wherein the controller is configured or programmed to perform the azimuth control during an automatic watercraft maneuvering control in which a bow azimuth of the hull is maintained during sailing.

11. A watercraft comprising:

a hull; and the watercraft propulsion system according to claim 1 on the hull.

* * * * *